US007322766B2

(12) United States Patent
Erlebacher et al.

(10) Patent No.: US 7,322,766 B2
(45) Date of Patent: Jan. 29, 2008

(54) WRITING INSTRUMENT WITH A SHEET MATERIAL DISPENSER

(75) Inventors: Jacqueline Erlebacher, Chicago, IL (US); Andrew M. Bielecki, Evanston, IL (US); Barry H. Jacobs, Forest Park, IL (US); Jaime Arenas, Oak Park, IL (US); Brian D. Furlong, Westchester, IL (US); Danny R. Smith, Jr., Glen Ellyn, IL (US)

(73) Assignee: Sanford, L.P., Oak Brook, IL (US)

( * ) Notice: Subject to any disclaimer, the term of this patent is extended or adjusted under 35 U.S.C. 154(b) by 184 days.

(21) Appl. No.: 10/803,349

(22) Filed: Mar. 18, 2004

(65) Prior Publication Data

US 2004/0234326 A1 Nov. 25, 2004

Related U.S. Application Data

(60) Provisional application No. 60/455,532, filed on Mar. 18, 2003, provisional application No. 60/468,874, filed on May 8, 2003, provisional application No. 60/490,849, filed on Jul. 28, 2003.

(51) Int. Cl.
*B43K 29/00* (2006.01)
*B43K 5/00* (2006.01)

(52) U.S. Cl. ..... 401/195; 401/202

(58) Field of Classification Search ..... 401/195, 401/52, 202; 206/407, 403, 408, 409
See application file for complete search history.

(56) References Cited

U.S. PATENT DOCUMENTS 2,073,719 A * 3/1937 Ross ..... 242/588.1
2,224,470 A 12/1940 Boust
4,416,392 A 11/1983 Smith (Continued)

FOREIGN PATENT DOCUMENTS

DE 451884 11/1927

(Continued)

OTHER PUBLICATIONS

International Search Report for International Patent Appl. No. PCT/US04/008490, dated Jan. 7, 2005, 8 pages.

(Continued)

*Primary Examiner*—David J. Walczak
(74) *Attorney, Agent, or Firm*—Marshall, Gerstein & Borun LLP

(57) ABSTRACT

In one embodiment of a writing instrument with a tape flan dispenser, a writing instrument has a body portion, a writing tip, and a flag dispenser chat can be attached to and detached from the body portion. The flag dispenser holds a supply of tape flags, such as a folded stack of tape flags, which can be removed through an opening in the dispenser. The flag dispenser can be, for example, a cap that covers the writing tip or an attachment that affixes to an end of the body portion. In another embodiment, a writing instrument has a body portion, a writing tip, a flag dispenser integrally incorporated into the body portion, a containing section housed in the flag dispenser, and an opening in the containing section through which tape flags can be issued.

55 Claims, 22 Drawing Sheets

U.S. PATENT DOCUMENTS

| | | | |
|---|---|---|---|
| 4,667,828 | A | 5/1987 | Samuelson |
| 4,770,320 | A | 9/1988 | Miles et al. |
| 4,796,781 | A | 1/1989 | Windorski |
| 4,812,069 | A | 3/1989 | White et al. |
| 4,907,825 | A | 3/1990 | Miles et al. |
| 4,921,127 | A | 5/1990 | Windorski |
| 4,957,233 | A | 9/1990 | Samuelson |
| 4,986,440 | A | 1/1991 | Windorski |
| 4,989,801 | A | 2/1991 | Thomas et al. |
| 4,993,590 | A | 2/1991 | Windorski |
| 5,059,435 | A | 10/1991 | Sloan et al. |
| 5,072,686 | A | 12/1991 | Falco |
| 5,080,255 | A | 1/1992 | Windorski |
| 5,158,205 | A | 10/1992 | Bodziak et al. |
| 5,165,570 | A | 11/1992 | Windorski et al. |
| 5,167,346 | A | 12/1992 | Bodziak |
| 5,411,168 | A | 5/1995 | Mertens et al. |
| 5,670,014 | A | 9/1997 | Mendelovich et al. |
| 5,697,518 | A | 12/1997 | Callahan, Jr. |
| 5,769,270 | A | 6/1998 | Fujisawa et al. |
| 5,904,806 | A | 5/1999 | Mendelovich et al. |
| 6,210,768 | B1 | 4/2001 | Blok et al. |
| 6,283,661 | B1 * | 9/2001 | Connors ..... 401/195 |
| 6,354,754 | B1 | 3/2002 | Pan |
| 6,398,178 | B1 | 6/2002 | Azola et al. |
| 6,719,472 | B2 | 4/2004 | Windorski et al. |
| 2003/0000958 | A1 | 1/2003 | Windorski et al. |
| 2004/0234326 | A1 | 11/2004 | Erlebacher et al. |
| 2005/0058497 | A1 | 3/2005 | Marschand |

FOREIGN PATENT DOCUMENTS

| | | | |
|---|---|---|---|
| DE | 29709080 | U1 | 10/1998 |
| DE | 10030440 | A1 | 1/2002 |
| EP | 0416181 | A1 | 3/1991 |
| GB | 2 106 044 | A | 4/1983 |
| JP | 11139081 | A | 5/1999 |
| JP | 2000025386 | A | 1/2000 |
| WO | WO 03/002357 | A1 | 1/2003 |

OTHER PUBLICATIONS

Written Opinion for International Patent Appl. No. PCT/US04/008490, dated Jan. 7, 2005, 5 pages.

* cited by examiner

WRITING INSTRUMENT WITH A SHEET MATERIAL DISPENSER

CROSS-REFERENCE TO RELATED APPLICATION

This application claims the benefit under 35 U.S.C. § 119(e) U.S. provisional patent application Ser. No. 60/455,532 filed Mar. 18, 2003, Ser. No. 60/468,874 filed May 8, 2003, and Ser. No. 60/490,849 filed Jul. 28, 2003, the disclosures of which are incorporated herein by reference.

BACKGROUND OF THE DISCLOSURE

1. Field of the Disclosure

The disclosure relates generally to writing instruments and, more particularly, to a writing instrument with a sheet material dispenser.

2. Related Art

Writing instruments such as highlighters, markers, pens, and pencils are used to mark passages in books, magazines, newspapers, and other printed publications. Highlighters of a variety of colors are very commonly used to emphasize text in printed publications. For instance, Sanford Corporation L. P. (Bellwood, Ill.) produces ACCENT® highlighters, which come in many different colors. Such highlighters are well received by students, teachers, and those in the legal profession.

Further, people may mark pages of printed publications. One method of locating a particular page of a printed publication such as a book is to apply a tape flag to mark a page for future reference. In particular, the tape flag may include an adhesive portion and a non-adhesive portion. The adhesive portion may be applied to a surface (e.g., a page of the book) while the non-adhesive portion may be a visual indicator. For example, the non-adhesive portion may be a variety of colors and/or shapes. Another use of tape flags is to mark a section of a page. Accordingly, the non-adhesive portion may also be a variety of letters, numbers, and/or messages. For example, the non-adhesive portion may include a message such as "Sign Here," "Notarize," "Initial Here," or "Sign & Date."

Because a variety of writing instruments and tape flag dispensers are used to mark passages in printed publications, this necessarily requires purchasing, carrying, and/or using many separate individual products. Integrating a writing instrument and a tape flag dispenser into a single product can reduce the inconveniences of purchasing, carrying, and/or using many separate individual products.

SUMMARY OF THE DISCLOSURE

Described herein are writing instruments with sheet material dispensers. In one of the various embodiments, a writing instrument includes a body portion and a cap portion. The body portion includes a first end and a second end. Further, the body portion in this embodiment is configured to hold a marking element that extends from an opening at the first end. The cap portion is configured to cover an exposed portion of the marking element to preserve a fluid or ink of the marking element when the writing instrument is not being used. In this embodiment of the writing instrument, the cap portion is also configured to dispense sheet material, such as tape flags. For example, the cap portion may include a barrel portion and a base portion. A roll of tape flags may be secured around the barrel portion. The base portion may include an opening so that an end of a roll of tape flags may be dispensed from the cap portion of the writing instrument.

In another of the various embodiments, the writing instrument includes a removable sheet material dispenser other than the cap. The dispenser may include a base portion configured to hold a roll or a stack of sheet material, such as tape flags. A base portion may include an opening so that an end of the roll or the stack of tape flags can be dispensed from the tape flag dispenser. The dispenser may be configured to engage the body portion of the writing instrument at the second end so that the writing instrument and the tape flag dispenser are coupled into a single component.

In a particular embodiment, a writing instrument has a body portion, a writing tip held by the body portion, and a flag dispenser that can be attached to and detached from the body portion. The flag dispenser has an inner barrel and an outer housing, with a containing section formed in between the inner barrel and the outer housing. The outer housing of the dispenser has an opening with dimensions that allow a tape flag to be fit through the opening. The containing section is dimensioned to hold a supply of one or more tape flags, which can be removed through the opening in the dispenser. The body portion of the writing instrument has a neck portion, with the writing tip extending from the neck portion.

In one implementation, the flag dispenser is a cap that can be attached to the neck portion, covering the writing tip. In another embodiment, the flag dispenser is attached to an end of the body portion.

The sheet material may be a stack of individual tape flags. Alternatively, the sheet material may be a roll of individual tape flags or a roll of adhesive tape suitable for being cut into individual tape flags. The body portion of the writing instrument has a substantially cylindrical cross section or a substantially polygonal cross section. The opening in the outer housing is preferably a slit aligned in the direction of an axis of the body portion, and the containing section preferably houses a roll of tape flags that are issued radially through the opening. Alternatively, the opening can be a slit aligned perpendicular to the direction of an axis of the body portion, and the containing section can house a stack of tape flags issued axially through the opening. The flag dispenser is preferably refillable, with access available to replenish the supply of tape flags. Alternatively, the flag dispenser can be made disposable, with no access to the supply of tape flags.

In another embodiment, a writing instrument has a body portion, a writing tip held by the body portion, a flag dispenser integrally incorporated into the body portion, a containing section housed in the flag dispenser and adapted to hold one or more tape flags, and an opening in the containing section through which tape flags can be issued.

This disclosure will describe several embodiments to illustrate its broad teachings. Reference is also made to the attached drawings.

DETAILED DESCRIPTION

Figure 1:
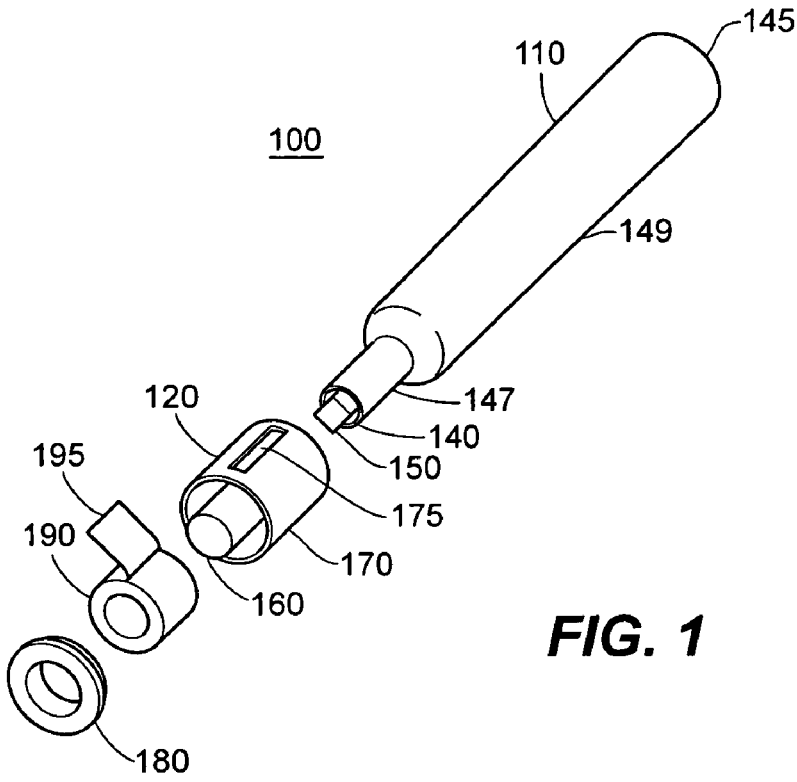
FIGS. 1 and 2 show one configuration of a writing instrument configured to dispense sheet material.
Figure 2:
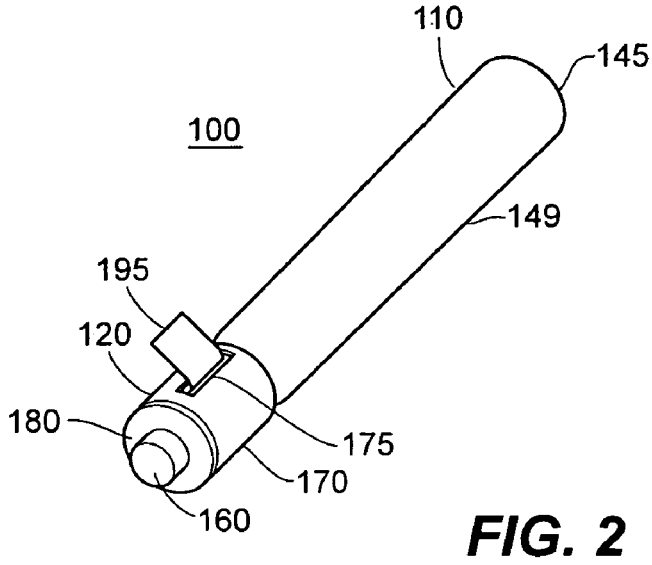

Referring to FIGS. 1 and 2, a writing instrument generally designated 100 includes a body portion 110 and a cap portion 120. The writing instrument 100 may be, but is not limited to, a highlighter, a marker, a pen, or a pencil. The body portion 110 may have a cylindrical bottle-like configuration extending from a first end 140 to a second end 145. In particular, the body portion 110 may include a neck section 147 proximate to the first end 140 and a tubular section 149 extending toward the second end 145 from the neck section 147. The body portion 110 may be configured to hold a marking element 150, which extends through an opening of the neck section 147 to apply a fluid or ink to a surface (e.g., a page in a book). The cap portion 120 may be configured to engage the neck section 147 of the body portion 110 to cover an exposed portion of the marking element 150 (i.e., the portion of the marking element 150 extending from the opening of the neck section 147). In particular, the cap portion 120 may include a barrel portion 160, a base portion 170, and a top portion 180. The barrel portion 160 may be an elongated central section of the cap portion 120 so that the neck section 147 and the exposed portion of the marking element 150 can be inserted into the barrel portion 160 when the writing instrument 100 is not being used. As a result, the fluid or ink of the marking element 150 can be preserved from drying out.

The cap portion 120 may also be configured to store and to dispense sheet material, such as tape flags. As generally known in the art, a tape flag may comprise a sheet of paper, plastic, or other material having an adhesive portion and a non-adhesive portion. The material may be provided in any desired color and may bear any desired indicia or message. While the embodiments are described herein specifically with reference to dispensing tape flags, it will be appreciated that the dispensers may be used to dispense other types of sheet material.

As best shown in FIG. 1, a plurality of tape flags is provided as a stack of tape flags that has been folded transversely to create a bent stack of tape flags. While the illustrated transverse fold is gradual to form the stack of tape flags in a generally cylindrical shape, it will be appreciated that the transverse fold may be more abrupt to create a V- or compressed C-shape. The tape flags may be inserted as a unit into the cap portion 120 over the barrel portion 160, so that the tape flags 190 are disposed radially about the barrel portion 160. An end 195 of the tape flags 190 can pass through an opening 175 that may extend axially along the base portion 170. The opening 175 may be configured to a size and shape so that the end 195 of tape flags 190 may extend through the opening 175. For example, the opening 175 may be, but is not limited to, a slot, a slit, or a notch. Accordingly, the tape flags can be dispensed radially relative to the writing instrument 100 from the cap portion 120 through the opening 175. To secure the tape flags 190 within the cap portion 120, the top portion 180 may engage the barrel portion 160 or the base portion 170. For example, the top portion 180 may be, but is not limited to, an annular ring inserted through the barrel portion 160.

A tape flag can be dispensed from the writing instrument 100 by pulling the end 195 of the tape flags 190 through the opening 175. If the tape flags are provided as a continuous roll, perforations or other separation means may be formed throughout the continuous roll 190 to facilitate separation of a leading end from the remainder of the roll. The tape flags 190 may be free to rotate around the barrel portion 160 so that a pulling force applied to separate the leading flag from the roll 190 also positions a subsequent flag in the opening 175. When the writing instrument 100 is in use (i.e., the cap portion 120 is disengaged from the body portion 110 at the first end 140 to expose the marking element 150), the cap portion 120 can be inserted into the second end 145 of the body portion 120 for storage.

Because the top portion 180 is removable from the cap portion 120, the writing instrument 100 can be refilled and/or changed with a new supply of tape flags, which may take the form of a continuous roll, rolled or bent stack, or other configuration as needed. To replace the tape flags 190, a user first removes top portion 180, and then removes a central support core (if any) of the old tape flags from barrel portion 160. The user then aligns a new supply of tape flags with the barrel portion 160 and slides the new supply adjacent the barrel portion 160. The user then draws a leading edge of a tape flag 195 through opening 175. Top portion 180 is then replaced onto base portion 170, enclosing the new roll of tape flags.

As described above, the cap portion 120 of the writing instrument 100 may be configured to dispense tape flags. Alternatively, the body portion 110 may be configured to dispense tape flags in a similar fashion. The writing instrument 100 may be coupled to a separate removable tape flag dispenser as an "add-on" component. That is, the writing instrument 100 and the removable tape flag dispenser may be separate sub-components that may be integrated into a single, composite component.

Figure 3:
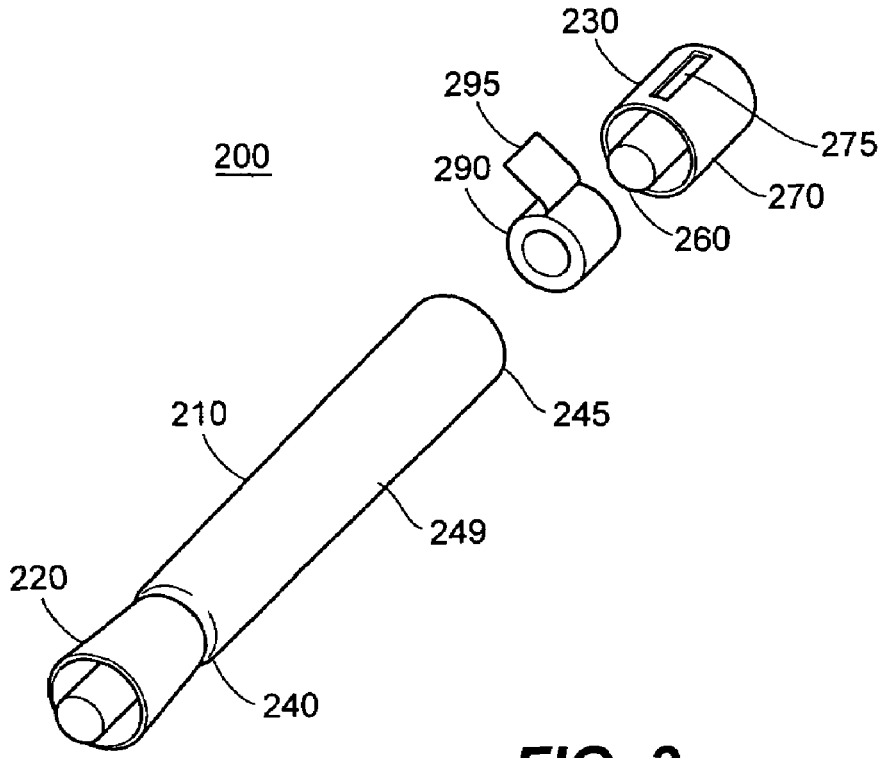
FIGS. 3 and 4 show one configuration of a writing instrument with a sheet material dispenser.
Figure 4:
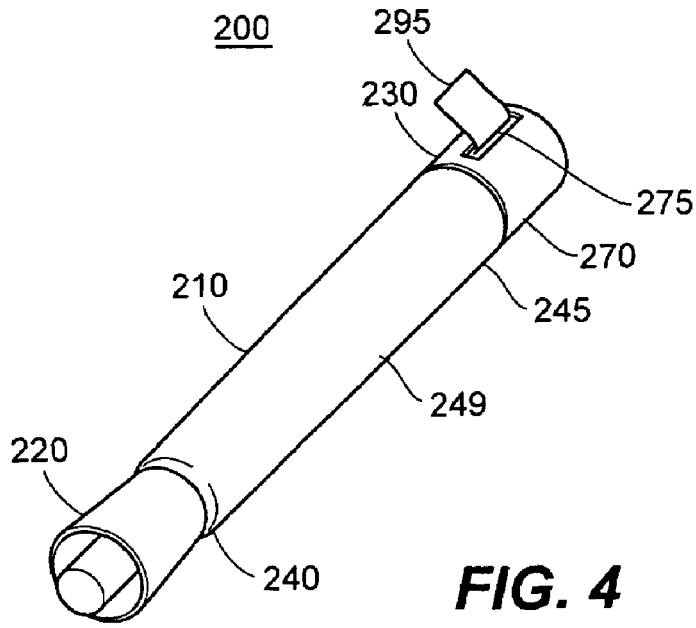

Referring to FIGS. 3 and 4, a writing instrument 200 may include a body portion 210, a cap portion 220, and a tape flag dispenser 230. Similar to the body portion 110 of the writing instrument 100 described in conjunction with FIGS. 1 and 2, the body portion 210 may have a cylindrical bottle-like configuration extending from a first end 240 to a second end 245. In particular, the body portion 210 may include a neck section (not shown) proximate to the first end 240 and a tubular section 249 extending from the neck section toward the second end 245. The body portion 210 may be configured to hold a marking element (not shown), which extends through an opening of the neck section to apply a fluid or ink to a surface. To cover the exposed portion of the marking element, the cap portion 220 of the writing instrument 200 may be configured to engage the neck section of the body portion 210. To use the writing instrument 200, the cap portion 220 may be disengaged from the body portion 210 at the neck section so that the marking element may be exposed to a surface.

As noted above, the writing instrument 200 may include a separate component to dispense tape flags. The tape flag dispenser 230 may be configured to engage the tubular section 249 of the body portion 210 at the second end 245. In particular, the tape flag dispenser 230 may include a barrel portion 260, and a base portion 270. A supply of tape flags 290 may be inserted into the tape flag dispenser 230 adjacent the barrel portion 260, so that the tape flags 290 are disposed radially about the barrel portion 260. The base portion 270 may include an opening 275 extending axially along a length of the base portion 270. The opening 275 may be configured to a particular size and shape so that an end 295 of the tape flags 290 can extend through the opening 275. For example, the opening 275 can be, but is not limited to, a slot, a slit, or a notch. Accordingly, the tape flags can be dispensed radially relative to the writing instrument 200 from the tape flag dispenser 230 through the opening 275. To secure the tape flags 290 within the tape flag dispenser 230, the tubular section 249 of the body portion 210 at the second end 245 can be configured to receive the tape flag dispenser 230 via the barrel portion 260. Accordingly, the body portion 210 and the tape flag dispenser 230 can be coupled together into the writing instrument 200.

Because the tape flag dispenser 230 is removable from the body portion 210, the writing instrument 200 can be refilled with and/or changed with new tape flags as needed. To replace the tape flags 290, a user first removes tape flag dispenser 230 from the second end 245 of body portion 210, and then removes a central support core (if any) of an old supply of tape flags from barrel portion 260. The user then aligns a new supply of tape flags with the barrel portion 260 and slides the new supply adjacent to the barrel portion 260. The user then draws a leading edge of a tape flag 295 through opening 275. Tape flag dispenser 230 is then replaced onto the second end 245 of body portion 210, enclosing the new supply of tape flags.

Although the tape flag dispenser 230 described above is particularly well suited for a body portion having a cylindrical shape, persons of ordinary skill in the art will readily appreciate that the teachings herein are not limited to such a writing instrument with such a particular shape. Persons of ordinary skill in the art will readily appreciate that the body portion may have a cross-section of other shapes such as, but not limited to, a square or a triangle. Accordingly, the tape flag dispenser 230 may be configured to engage a body portion having any one of those shapes.

Figure 5:
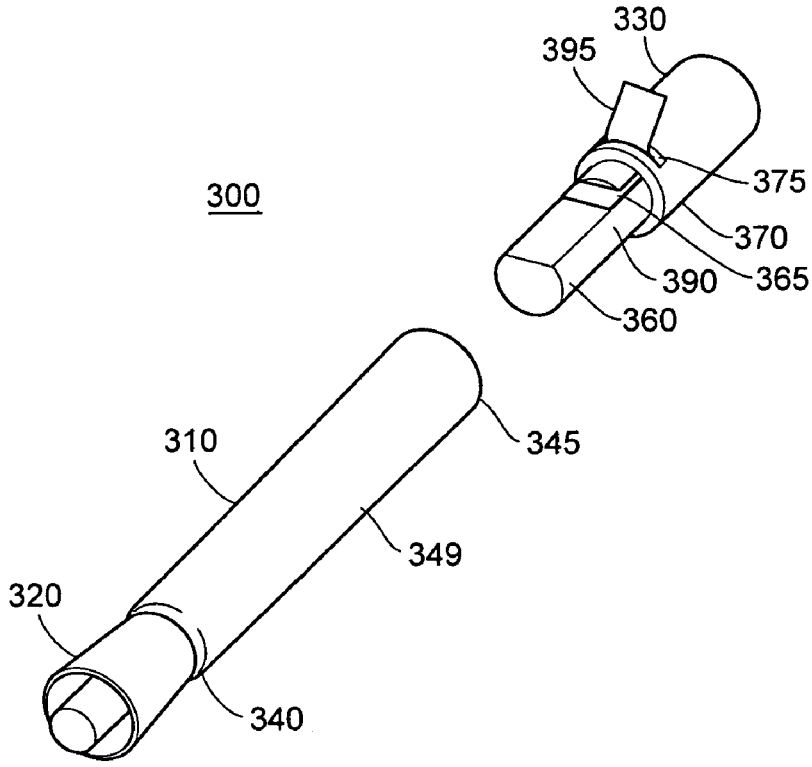
FIGS. 5 and 6 show another configuration of a writing instrument with a sheet material dispenser.
Figure 6:
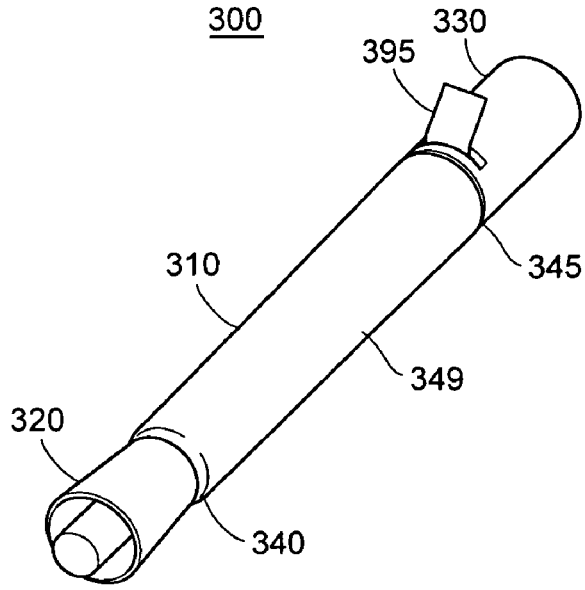

Instead of generally cylindrical or bent configurations as described above, tape flags may be stacked vertically on top of each other. Typically, for example, a tape flag may include an adhesive portion and a non-adhesive portion. The adhesive portion of a first tape flag may engage the non-adhesive portion of a second tape flag. Subsequent tape flags may engage one another in a similar manner. Accordingly, tape flags may be dispensed axially relative to the writing instrument. Referring to FIGS. 5 and 6, a writing instrument 300 may include a body portion 310, a cap portion 320, and a tape flag dispenser 330. The body portion 310 and the cap portion 320 may be configured similar to the body portions 110, 210 and the cap portions 120, 220, respectively, described above. In particular, the body portion 310 may have a cylindrical bottle-like configuration extending from a first end 340 to a second end 345. Further, the body portion 310 may include a neck section (not shown) proximate to the first end 340 and a tubular section 349 extending toward the second end 345 from the neck section. The body portion 310 may be configured to hold a marking element (not shown), which extends through an opening of the neck section to apply a fluid or ink to a surface. To cover the exposed portion of the marking element, the cap portion 320 of the writing instrument 300 may be configured to engage the neck section of the body portion 310. To use the writing instrument 300, the cap portion 320 can be disengaged from the body portion 310 at the neck section so that the marking element can be exposed to a surface.

Here, however, the tape flag dispenser 330 may be configured to store and to dispense a stack of tape flags 390 rather than a roll of tape flags. In particular, the flag dispenser 330 may include a top portion 360, and a base portion 370. The top portion 360 may be configured to engage the tubular section 349 of the body portion 310 at the second end 345. To store and secure the stack of tape flags 390, the top portion 360 can be inserted into the body portion 310 at the second end 345 as shown in FIG. 6.

The outer surface diameter of the base portion 370 may be greater than the outer surface diameter of the top portion 360. Thus, the outer surface of the base portion 370 of the tape flag dispenser 330 may be flush with the outer surface of the tubular section 349 of the body portion 310. In particular, the base portion 370 may include an opening 375 configured to a particular size and shape so that an end 395 of the stack of tape flags may extend through the opening 375. For example, the opening 375 may be, but is not limited to, a slot, a slit, and a notch. Accordingly, tape flags can be dispensed axially from the writing instrument 300.

Because the tape flag dispenser 330 is removable from the body portion 310, the writing instrument 300 can be refilled with and/or changed to a new stack of tape flags 390 as needed. To replace the stack of tape flags 390, a user first removes tape flag dispenser 330 from the second end 345 of body portion 310, and then removes a support base (if any) of an old stack of tape flags from a stack receptacle 365 in the tape flag dispenser 330. The user then inserts a new stack of tape flags into the stack receptacle 365 in the tape flag dispenser 330. The user then draws a leading edge of a tape flag 395 through opening 375. Tape flag dispenser 330 is then replaced onto the second end 345 of body portion 310, enclosing the new stack of tape flags.

Figure 7:
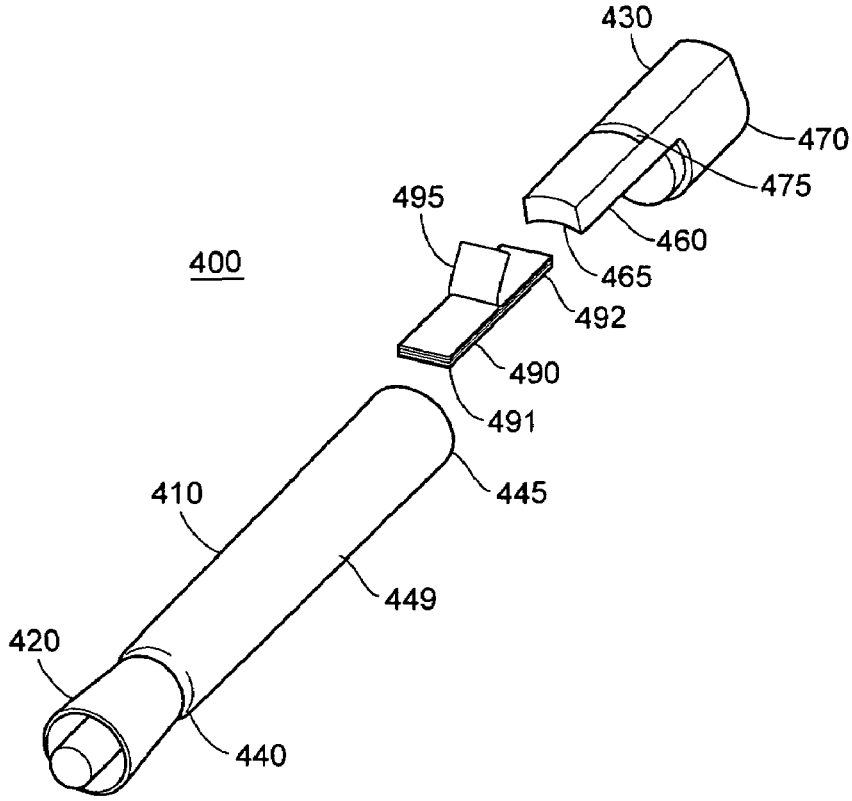
FIGS. 7 and 8 show yet another configuration of a writing instrument with a sheet material dispenser.
Figure 8:
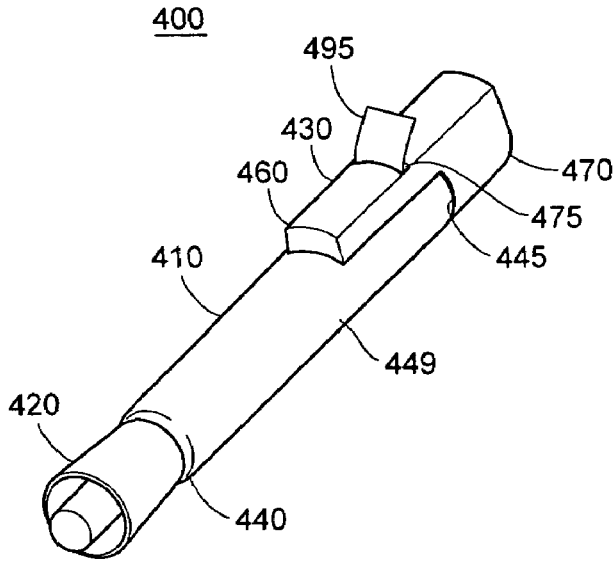

Another example of a writing instrument configured to dispense a stack of tape flags is shown in FIGS. 7 and 8. The writing instrument 400 may include a body portion 410, a cap portion 420, and a tape flag dispenser 430. The body portion 410 and the cap portion 420 may be configured similar to the body portions 110, 210, 310 and the cap portions 120, 220, 320, respectively, described above. In particular, the body portion 410 may have a cylindrical bottle-like configuration extending from a first end 440 to a second end 445. Further, the body portion 410 may include a neck section (not shown) proximate to the first end 440 and a tubular section 449 extending toward the second end 445 from the neck section. The body portion 410 may be configured to hold a marking element (not shown), which extends through an opening of the neck section to apply a fluid or ink to a surface. To cover the exposed portion of the marking element, the cap portion 420 of the writing instrument 400 may be configured to engage the neck section of the body portion 410. To use the writing instrument 400, the cap portion 420 can be disengaged from the body portion 410 at the neck section so that the marking element may be exposed to a surface.

Here, the tape flag dispenser 430 may include a mounting portion 460, and a base portion 470. The inner surface of the mounting portion 460 may be configured to store a stack of tape flags 490 and to mount onto the tubular section 449 of the body portion 410. For example, the outer surface of the tubular section 449 of the body portion 410 may be cylindrical. Accordingly, the inner surface of the mounting portion 460 may be concaved so that the tape flag dispenser 430 can be coupled to the body portion 410. The mounting portion 460 may extend over a length of the outer surface of the tubular section 449 of the body portion 410 to secure the stack of tape flags 490 to the body portion 410. The stack of tape flags 490 may be disposed on a portion of the tubular section 449 proximate to the second end 445. In particular, a first portion 491 of the stack of tape flags 490 can be secured to the outer surface of body portion 410 by the mounting portion 460 of the tape flag dispenser 430. A second portion 492 of the stack of tape flags 490 can be stored within the base portion 470. The mounting portion 460 and the base portion 470 may form an opening 475 such as, but is not limited to, a slot, a slit, and a notch. The opening 475 is configured to a particular size and shape so that an end 495 of the stack of tape flags 490 can extend through the opening 475. Accordingly, the tape flags can be dispensed axially from the writing instrument 400.

Because the tape flag dispenser 430 is removable from the body portion 410, the writing instrument 400 can be refilled with and/or changed to a new stack of tape flags as needed. To replace the stack of tape flags 490, a user first removes tape flag dispenser 430 from the second end 445 of body portion 410, and then removes a support base (if any) of an old stack of tape flags from a stack receptacle 465 in the tape flag dispenser 430. The user then inserts a new stack of tape flags into the stack receptacle 465 in the tape flag dispenser 430. The user then draws a leading edge of a tape flag 495 through opening 475. Tape flag dispenser 430 is then replaced onto the second end 445 of body portion 410, enclosing the new stack of tape flags.

The tape flags used can be stored in a variety of configurations. For example, the tape flags can be arranged as a stack of tape flags or in a roll of tape flags, as noted above. More particularly, in one version the roll of tape flags is a continuous roll of tape flags that have a unidirectional spiral structure. Another version of the roll of tape flags uses a stack of tape flags that has been subsequently bent or curled into the shape of a cylindrical roll. These two versions of the roll of tape flags have slightly different behaviors as their flags are withdrawn, and the particular dimensions of a tape flag dispenser can be modified accordingly. In one version of the tape flag dispenser, the dimensions are chosen so the tape flag dispenser can hold and dispense either a continuous roll of tape flags or a roll of tape flags made from a stack of tape flags rolled into a cylindrical shape.

Figure 9:
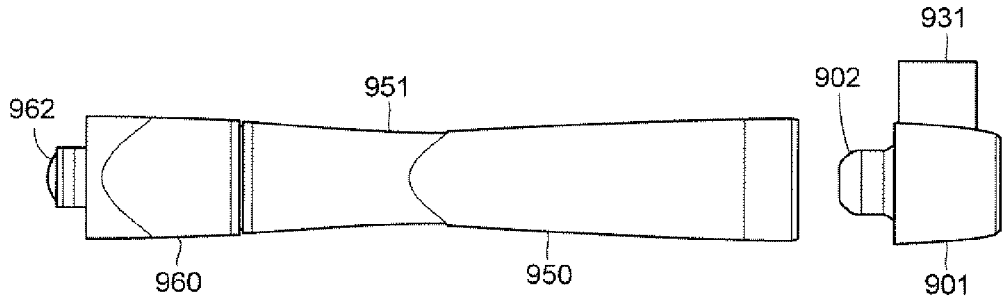
FIGS. 9 and 10 show one configuration of an add-on sheet material dispenser that can be attached to a writing instrument.
Figure 10:
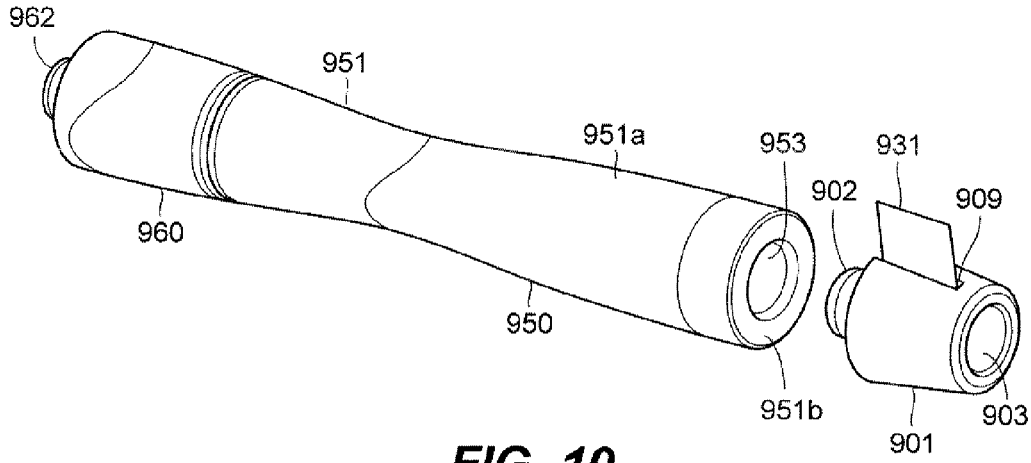

FIGS. 9 and 10 illustrate an add-on flag dispenser that can be attached to a writing instrument. In this embodiment, a flag cartridge 901 holding a supply of tape flags is configured to be attached to a highlighter 950. The flag cartridge 901 is preferably made of a partially pliable material, such as a plastic, and has a nub 902, a recess 903, and an opening such as slot 909 for dispensing tape flags 931. The nub 902 and recess 903 are preferably disposed at opposite ends of flag cartridge 901, with slot 909 located in a central portion of flag cartridge 901. Highlighter 950 has a body 951 and a cap 960 that is attached to one end of the body 951 for covering a writing tip (not shown). The body 951 includes a sidewall 951*a* and a rear wall 951*b* enclosing a rear end of the body 951. The rear wall 951 is disposed at an end of the body 951 and has a recess 953. A nub 902 is formed on cap 960.

The attachment between highlighter 950 and flag cartridge 901 is preferably a frictional or squeeze-fit attachment between nub 902 of flag cartridge 901 and recess 953 of highlighter 950. Nub 902 is dimensioned so that it fits snugly into recess 953. That is, this fit is chosen so that it is tight enough to hold firmly the mass of flag cartridge 901, but not so tight as to binder manual removal of flag cartridge 901 from highlighter 950.

On some versions of highlighter 950, nub 962 of cap 960 is dimensioned to similarly fit into recess 953 when flag cartridge 901 is detached from highlighter 950. Accordingly, in a corresponding embodiment of flag cartridge 901, nub 902 of flag cartridge 901 has the same dimensions as nub 962 of cap 960. In a preferred embodiment of flag cartridge 901, recess 903 of flag cartridge 901 also has the same dimensions as recess 953 of highlighter 950. With the recesses and nubs matching in this way, cap 960 can be stacked either onto highlighter 950 (when flag cartridge 901 is not present), or onto flag cartridge 901 (when flag cartridge 901 is attached to highlighter 950).

Depending on the dimensions of recess 903 in flag cartridge 901, the flag cartridge 901 may or may not fit over the writing tip normally covered by cap 960. Thus, in some embodiments of the add-on flag dispenser, flag cartridge 901 can serve as a replacement for cap 960. In other embodiments, flag cartridge 901 cannot replace cap 960.

Figure 11:
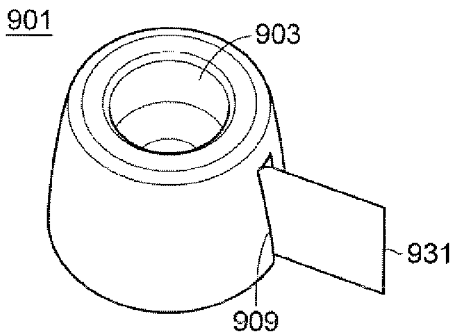
FIGS. 11 and 12 show one configuration of a sheet material cartridge.
Figure 12:
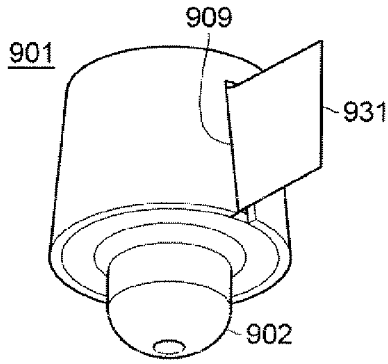

FIGS. 11 and 12 are closer views of flag cartridge 901. FIG. 11 is a top isometric view of flag cartridge 901, and FIG. 12 is a bottom isometric view of flag cartridge 901. The figures show one implementation of the flag cartridge 901, with nub 902, recess 903, and slot 909. Tape flag 931 is shown extending through slot 909, ready to be gripped and removed by a user.

As shown in FIG. 11, flag cartridge 901 has a substantially cylindrical geometry, with radial symmetry. In other implementations, flag cartridge 901 can be constructed with other shapes, such as with square, triangular, or other polygonal or even irregular cross sections. Recess 903 is shown in FIG. 11 as an indentation into one of the ends of the cylindrical structure of the flag cartridge 901, and slot 909 is shown aligned on the outer surface of the cylindrical structure, aligned in parallel with an axis of the cylindrical structure. This arrangement of slot 901 can be particularly useful for dispensing tape flags 931 that are stored inside flag cartridge 901 as a continuous roll of tape flags, as a helical roll of separate tape flags, or as a stack of tape flags folded into the shape of a cylindrical roll. In these cases, tape flags are dispensed radially from flag cartridge 901.

In an alternative arrangement (not shown), the slot 909 can be aligned perpendicular to the axis of the cylindrical structure. In this arrangement, the tape flags are dispensed axially from flag cartridge 901. This alternative can be well suited for flag cartridges in which the tape flags are stored as a stack rather than as a roll. In yet another arrangement, the slot 909 can be disposed on an end of the flag cartridge, replacing (or displacing) either the recess 903 or the nub 901 that are shown in FIG. 11.

The close-up view of FIG. 11 also illustrates that flag cartridge 901 can be sculpted with a desirable shape that is not completely cylindrical. For example, the flag cartridge 901 as illustrated in FIG. 11 has a tapered conical-like structure, so that its diameter decreases along its length from a larger diameter near the end with nub 902 to a smaller diameter at the end with recess 903. Such a taper or other detail in the structure might serve a functional purpose, such as making the flag cartridge easier to grip and easier to remove from a writing instrument.

The recess 903 of flag cartridge 901 is shown in FIG. 11 as having a cylindrical inner surface that tapers closed at its innermost depth, with an inner diameter chosen to securely clasp a nub of a cap or a neck of a writing instrument inserted into the recess. In other embodiments of the flag cartridge, the recess 903 can be equipped with radial slats or circumferential ridges to assist in the clasping operation.

FIG. 12 is a shifted view of the flag cartridge 901 from FIG. 11. This view shows the nub 902 of flag cartridge 901. Nub 902 preferably has a cylindrical structure attached to the body of flag cartridge 901 with a rounded end protruding away from the body of flag cartridge 901. Alternatively, nub 902 can be formed with a non-circular cross section, to appropriately match writing instruments with non-circular recesses. And rather than having a nub with a rounded end, further embodiments of flag cartridge 901 can be made with flat-ended or point-ended nubs.

Further, nub 902 can be replaced or supplemented by other structures for attaching to writing instruments. For example, instead of a nub, flag cartridge 901 can be equipped with a recess that appropriately matches a nub or protuberance on other writing instruments (not shown). Alternatively (or additionally), further embodiments of flag cartridge 901 can employ adhesive or screw-on structures for attaching to a writing instrument.

In some implementations, flag cartridge 901 is a disposable unit, pre-filled with a limited supply of tape flags. In other implementations, flag cartridge 901 is a refillable unit that can be re-stocked with a fresh supply of tape flags as needed.

Figure 13:
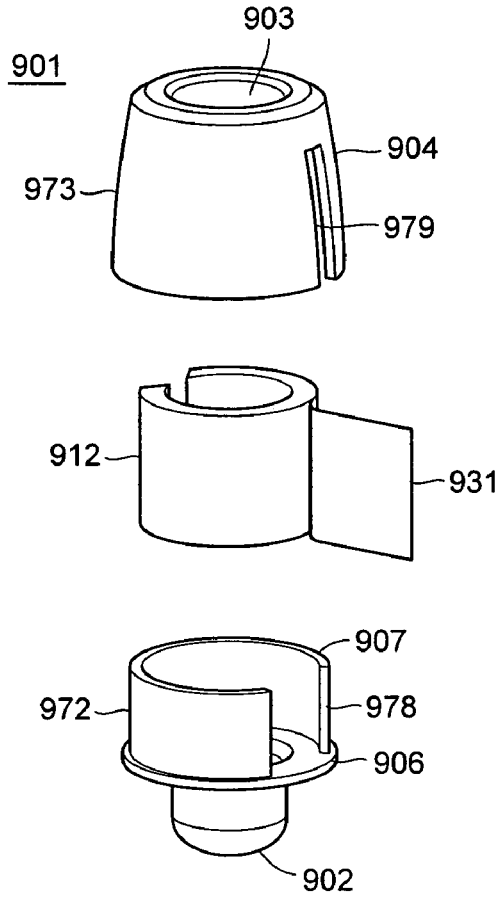
FIG. 13 shows one configuration of a refillable embodiment of a sheet material cartridge.

FIG. 13 shows an exploded view of a refillable embodiment of flag cartridge 901. In this embodiment, flag cartridge 901 includes a cartridge base 972, a dispenser housing, an example of which is a cartridge cap 973, and a supply of tape flags 912. Cartridge cap 973 has a tapered outer shell 904 that is open at one end, and closed at the other end where recess 903 is formed. An outer slot 979 is located on the tapered outer shell 904 of the cap 973, and extends to the edge of the open end of outer shell 904 of the cap 973. Cartridge base 972 has a partially cylindrical inner shell 907 and an end cover 906. Nub 902 is mounted on end cover 906. End cover 906 is also attached to a first end of inner shell 907, and closes off that first end of inner shell 907. An opposing end of inner shell 907 is open and unattached to any other elements of the base 972.

Inner shell 907 has an outer diameter that is equal to or smaller than the inner diameter of the outer shell 904. Thus, the open end of inner shell 907 can be fit into the open end of outer shell 904, forming an enclosure for tape flags. The diameters of outer and inner shells 904 and 907 are selected so that the enclosure for tape flags has appropriate dimensions to hold the supply of tape flags 912. Further, these diameters are preferably chosen so that outer and inner shells 904 and 907 fit snugly together: the cylindrical shells 904 and 907 can be firmly attached to one another, but are readily separated for refilling.

An inner slot 978 is formed on inner shell 907 at a location that can match the placement of outer slot 979 on outer shell 904. That is, when outer and inner shells 904 and 907 are fit together, outer slot 979 is located over inner slot 978, thereby creating slot 909 (from FIGS. 11 and 12) that communicates into the enclosure for tape flags.

With cartridge cap 973 separated from cartridge base 972—that is, with the flag cartridge "open"—the supply of tape flags 912 can be inserted into the inner shell 907 of cartridge base 972, with a leading tape flag 931 extending through inner slot 978. Inner shell 907 can then be inserted into outer shell 904—to "close" flag cartridge 901—while ensuring that tape flag 931 also extends through outer slot 979.

The end cover 906 of cartridge base 972 preferably also includes an extension that reaches radially outwards beyond an outer surface of inner shell 907. This extension servers as a stopper for cartridge cap 973, when cartridge cap 973 is being placed onto cartridge base 972.

While this depiction of a refillable flag cartridge involves round-like structures, such as outer and inner shells 904 and 907, as noted above, other geometries (triangular or other polygonal cross sections) can be used as appropriate to a particular application.

Depending on a specific implementation, it is noted that flag cartridge 901 can be configured for use as a replacement for cap portion 120 of FIGS. 1 and 2. Also, flag cartridge 901 can be configured for use as a replacement for tape flag dispenser 230 of FIGS. 3 and 4.

Figure 14:
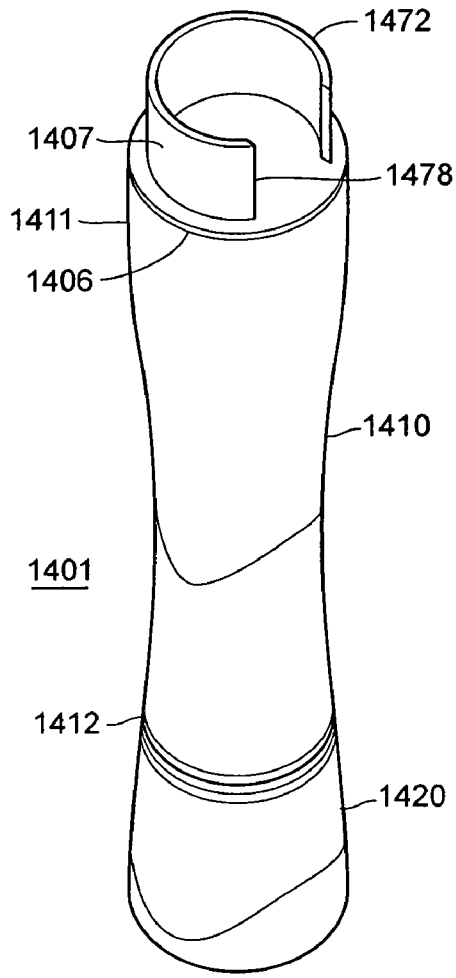
FIGS. 14 and 15 show one configuration of a writing instrument with a cartridge base.
Figure 15:
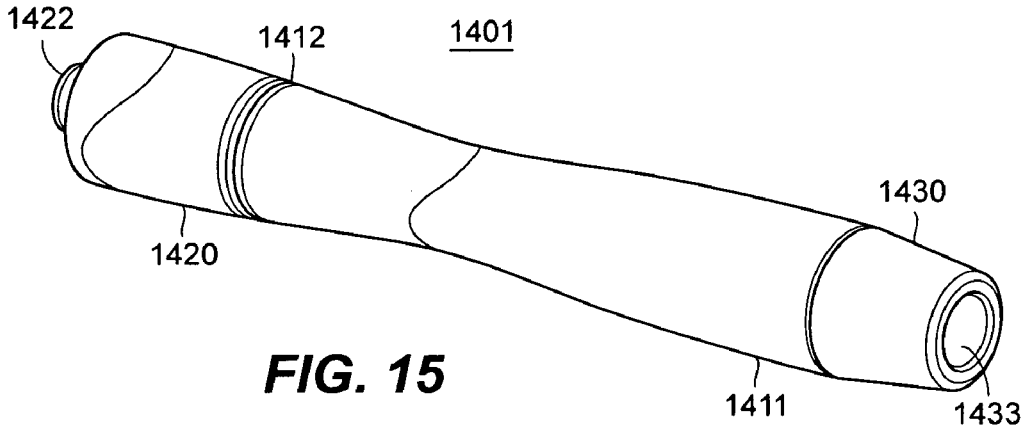

In other versions of the refillable add-on flag dispenser, the cartridge base can be integrally attached onto an end of a writing instrument, so that the writing instrument is prepared to receive a cartridge cap and tape flags. FIGS. 14 and 15 illustrate an embodiment of such a writing instrument. In these figures, a highlighter 1401 has a body portion 1410 suitable for being gripped by a user. At opposing ends of the body portion 1410 are a back end 1411 and a writing end 1412. A removable cap 1420 is affixed at the writing end 1412, covering and protecting a writing tip (not shown).

As illustrated in FIG. 14, a base portion 1472 is mounted on the back end 1411 of highlighter 1401. Base portion 1472 includes a cylindrical-like inner shell 1407 (corresponding to inner shell 907 from FIG. 13), an inner slot 1478 (corresponding to inner slot 978 from FIG. 13), and an end cover 1406 (corresponding to end cover 906 from FIG. 13). End cover 1406 serves a dual role: one side of end cover 1406 is a mounting surface for inner shell 1407, while the opposite side of cover 1406 closes the back end 1411 of highlighter 1401.

A cartridge cap (such as cartridge cap 973 from FIG. 13) can be affixed to base portion 1472, creating an enclosure therein for a supply of tape flags as discussed earlier in the discussion of FIG. 13. Since base portion 1472 is mounted directly onto highlighter 1401, the cartridge cap 973 and the highlighter 1401 make a useful two-component system.

As shown in FIG. 15, base portion 1472 can be covered by a cosmetic non-dispensing rear cap 1430 when the cartridge cap 973 is not present. Thus, if no tape flags are desired by a user of this embodiment, the supply of tape flags and the cartridge cap 973 can be removed or discarded. The non-dispensing rear cap 1430 has no slot for dispensing tape flags. In a preferred embodiment, non-dispensing rear cap 1430 is provided with a recess 1433 that is similar to recess 903 and into which cap 1420 can be affixed when highlighter 1401 is being used to write or draw.

The above-described embodiments involve housings that hold a supply of tape flags. As noted in the discussion of FIGS. 1-15, tape flags can be stored in a variety of configurations in highlighters and other writing instruments. The tape flags can be stored, for example, in continuous or perforated rolls, in stacks, or in folder or rolled stacks. Different geometries can be selected as needed for various implementations of a writing instrument-flag dispenser combination. For example, rolled stacks of tape flags can be particularly suitable for tape flag dispensers that dispense flags in a radial direction and are removably mounted on an end of a writing instrument.

FIGS. 16-26 illustrate a variety of techniques for storing tape flags in or on a writing instrument. These techniques can be readily used in combination with the above-described embodiments of and other writing instruments.

Figure 16:
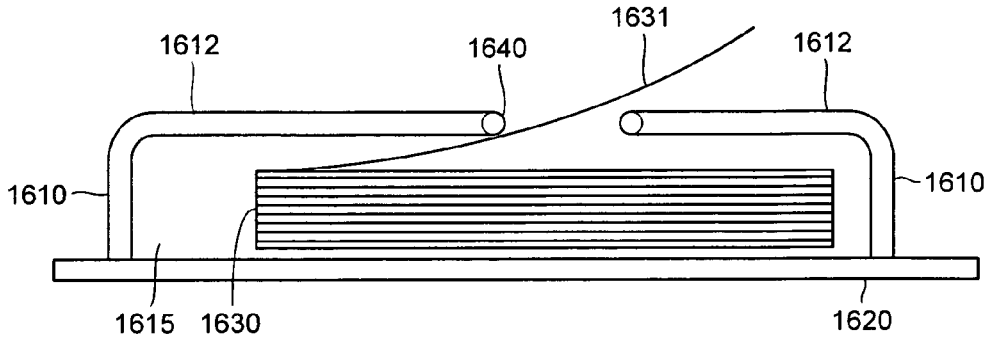
FIGS. 16-18 are schematic diagram representations of some various embodiments of sheet material housings.

FIG. 16 illustrates a side cross-section of one embodiment of a tape-flag housing mounted on or in a writing instrument, such as the writing instruments described above in the discussion of FIGS. 5-8. In this embodiment, the housing includes four side walls 1610, a top wall 1612, and a lower wall 1620. (In this cross-section, only two of the four side walls are shown.) Lower wall 1620 is formed from the outer surface of a writing instrument. Alternatively, lower wall 1620 can be the inner surface of a removable housing, or the inner surface of a removable tape-flag dispenser. Side walls 1610 extend from lower wall 1620, and top wall 1612 extends from side walls 1610. Together the walls 1610, 1612, and 1620 form an enclosure 1615 into which a supply of tape flags 1630 can be stored. A slot 1640 is disposed in top wall 1612, through which a tape flag 1631 can be removed from the supply of tape flags 1630.

The assembly of side, top, and lower walls 1610, 1612, and 1620 can preferably be disassembled, so that the enclosure 1615 can be opened for replacing the supply of tape flags 1630. For example, the side walls 1610 can be attached to lower wall 1620 by frictional tab-slot couplings. Thus, side walls 1610 can be made detachable from lower wall 1620, allowing chamber 1615 to be opened and the supply of tape flags 1630 to be replaced.

Alternatively, a cartridge such as the assembly in FIG. 16 can be permanent, so that the assembly of side, top, and lower walls 1610, 1612, and 1620 can not be disassembled, making the supply of tape flags 1630 un-replaceable. This alternative would be useful in a disposable implementation of a flag cartridge, or in a disposable implementation of a writing instrument with a tape-flag supply. Such an implementation could lower production costs and allow users the convenience and/or reduced cost of having a disposable unit.

As shown in the side cross-sectional view of FIG. 16, the enclosure 1615 for the supply of tape flags 1630 has an inner space that is larger than the dimensions of a supply of tape flags. Thus, there is room inside enclosure 1615 for the supply of tape flags to "float" or move at least slightly within the enclosure. In this implementation, the slot 1640 through which tape flags are removed can preferably be made narrow, since the supply of tape flags 1630 can move enough to properly re-align itself as needed with the slot 1640.

Figure 17:
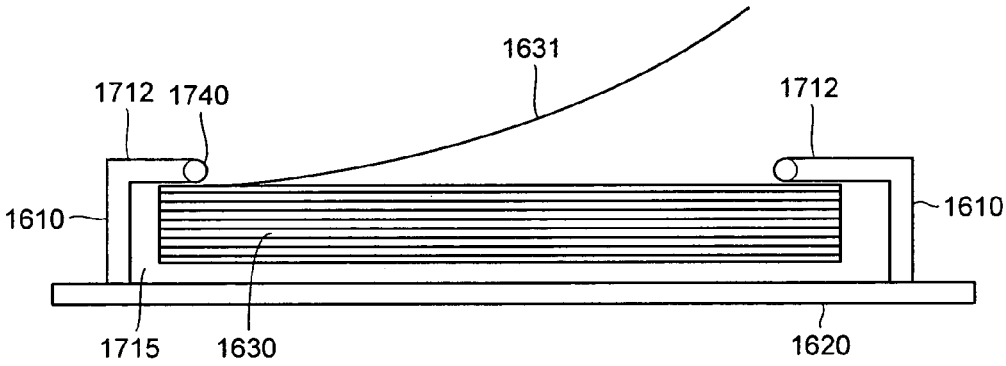

FIG. 17 shows a side cross-sectional view of another embodiment of a tape flag housing suitable for mounting on or in a writing instrument, such as the writing instruments described above in the discussion of FIGS. 5-8. Here the tape flag housing includes side and lower walls 1610 and 1620, supply of tape flags 1630, and an extending tape flag 1631 as described above with respect to FIG. 16. This embodiment also has a top wall 1712 with a slot 1740 that is preferably wider than the slot 1640 that was presented in FIG. 16. An enclosure 1715 is formed by the walls 1610, 1712, and 1620, and is dimensioned so that enclosure 1715 closely fits around the supply of tape flags 1630. In this case, the supply of flags 1630 is fixed at its edges by walls 1610, 1712, and 1620, and is substantially constrained from moving or rattling in the enclosure 1715. Accordingly, slot 1740 in top walls 1612 is preferably made wide, so that tape flags can readily be drawn through the slot 1740.

Figure 18:
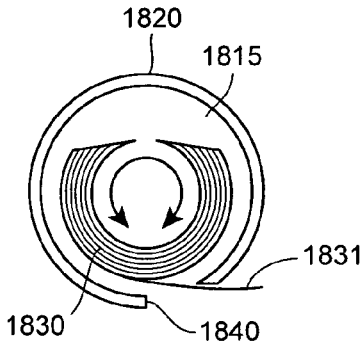

FIG. 18 shows a top cross-sectional view of another embodiment of a tape-flag housing suitable for mounting on or integral with a writing instrument, such as the writing instruments described above in the discussion of FIGS. 1-4. Here, tape flags are loosely stored in a cylindrical-like housing suitable for mounting on the end of a writing instrument. In this embodiment, a cylindrical-like shell 1820 has an inner enclosure 1815 and a slot 1840. A supply of tape flags 1830 is housed in the inner enclosure 1815, with room to move or rotate at least slightly within the inner enclosure 1815. A tape flag 1831 can be drawn from the supply of tape flags through the slot 1840 in the shell 1820. In this embodiment, slot 1840 is preferably made narrow.

Figure 19A:
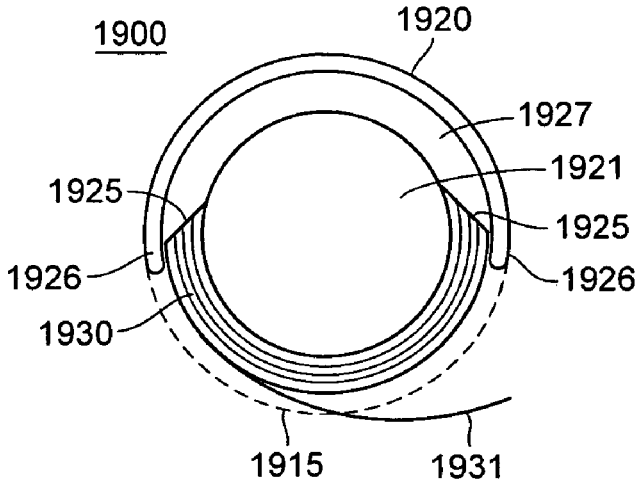
FIGS. 19A and 19B illustrate a particular embodiment of a sheet material housing.
Figure 19B:
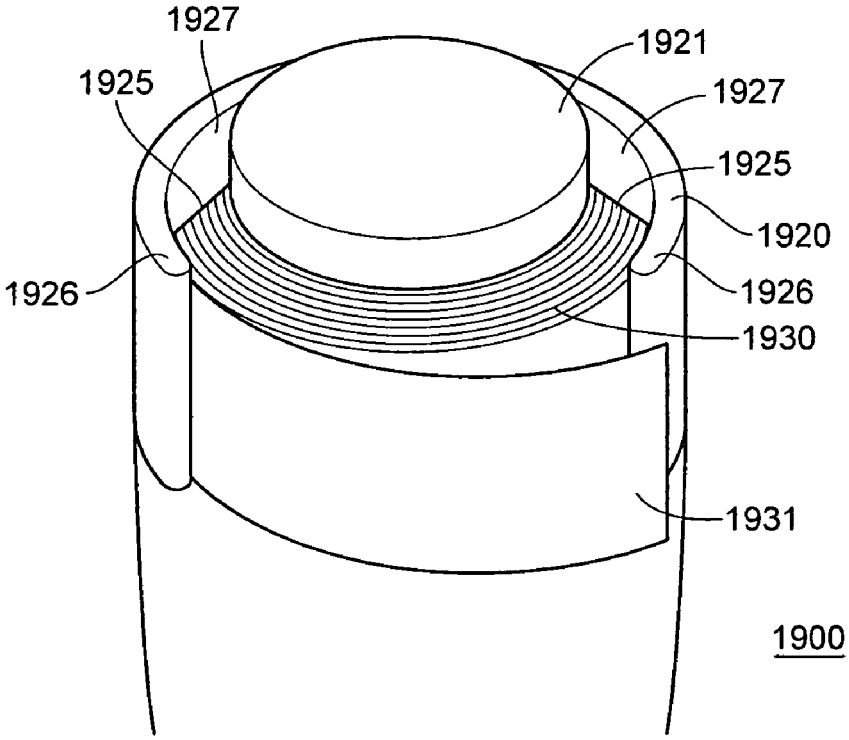

FIGS. 19A and 19B show a further embodiment of a tape-flag housing 1900, in which tape flags are tightly stored in a round housing suitable for mounting on or in a writing instrument, such as the writing instruments described above in the discussion of FIGS. 1-4. FIG. 19A is a top cross-sectional view and FIG. 19B is an angled side view of this tape-flag housing 1900. Tape-flag housing 1900 includes a partial cylindrical shell 1920, an edge-blocking portion 1927, and a central blocking portion 1921. The edge-blocking portion 1927 is connected to and located between partial cylindrical shell 1920 and central blocking portion 1921.

In this embodiment, partial cylindrical shell 1920 subtends a grasping region 1915 (marked by dashed lines). A supply of tape flags 1930, such as a rolled stack of tape flags, is clasped at edges 1925 by partial cylindrical shell 1920. The edges 1925 of the supply of tape flags 1930 are pressed against edge-blocking portion 1927, and a middle portion of the supply of tape flags 1930 is supported by central block 1921. In a preferred implementation, partial cylindrical shell 1920 is a C-clamp structure for grasping the tape flags. A tape flag 1931 can be drawn directly from the supply of tape flags 1930 and pulled away from the grasping region 1915. The edge-blocking portion 1927, partial cylindrical shell 1920, and central blocking portion 1921 are preferably mounted integrally onto an end of a highlighter or other writing instrument, as discussed above (for example, with reference to FIG. 14). Alternatively, these components can be incorporated into a removable tape-flag dispenser, as was also discussed above (for example, with reference to FIG. 13).

Figure 20:
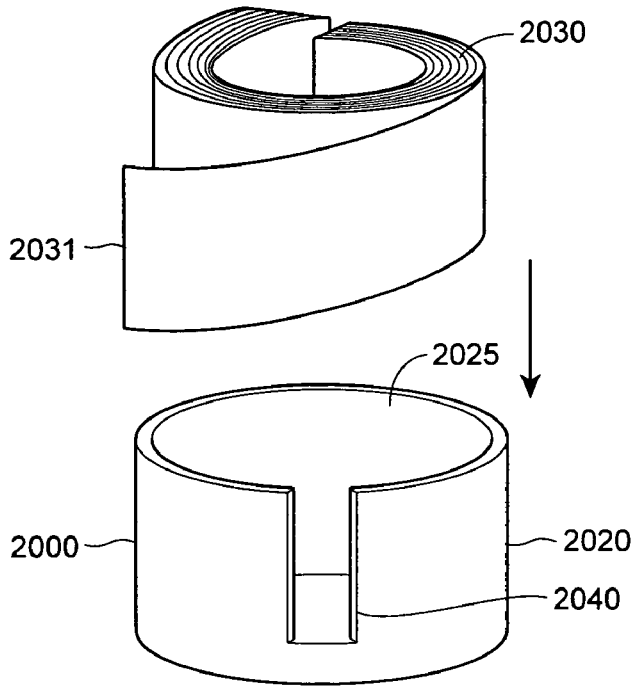
FIGS. 20 and 21 are schematic diagram representations of some further embodiments of sheet material housings.

FIG. 20 illustrates one embodiment of a tape-flag housing 2000 that can be incorporated into a writing instrument or into a tape-flag dispenser, such as the embodiments of writing instruments and dispensers discussed above-with respect to FIGS. 1-4, 9-15, 18, and 19. The housing 2000 is formed of a cylindrical shell 2020 within which is a chamber 2025. The chamber 2025 has dimensions suitable for holding a supply of tape flags 2030. In a preferred, implementation, housing 2000 is used as an inner-shell portion with a base or a writing instrument that has an outer-shell portion (such as 904 from FIG. 13, so that shell 2020 replaces inner-shells 907 or 1407). Housing 2000 can thus serve as an outer shell for a tape-flag chamber. In a preferred version of the housing 2000, the chamber 2025 is dimensioned to hold a rolled or folded stack 2030 of approximately 35 (20 to 50) tape flags. Disposed on the surface of cylindrical shell 2020 is a narrow slot 2040 aligned in an axial direction. This slot 2040 is sufficiently wide to allow a single leading tape flag 2031 to be drawn through the slot 2040, but narrow enough to prevent the supply of tape flags 2030 from being withdrawn through the slot 2040. Thus, in refillable implementations of the writing instrument or tape-flag dispenser, the supply of tape flags 2030 can be reloaded through an open top section of the chamber—that is, reloaded in an axial direction.

Figure 21:
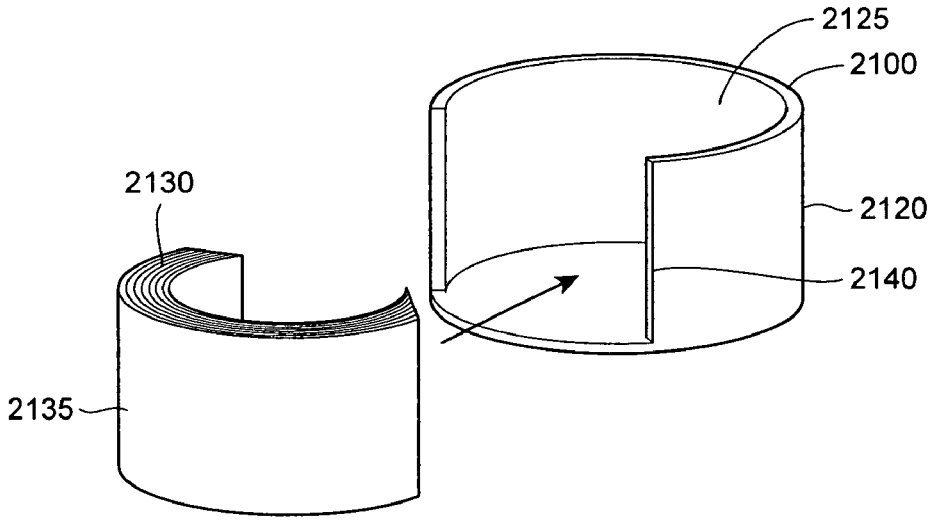

FIG. 21 illustrates another embodiment of a tape-flag housing 2100 that can be incorporated into a writing instrument or into a tape-flag dispenser, such as the embodiments of writing instruments and dispensers discussed above with respect to FIGS. 1-4, 9-15, 18, and 19. The housing 2100 is formed of a cylindrical-like shell 2120 that corresponds to shell 2020 from FIG. 20, within which is a chamber 2125. The chamber 2125 has dimensions suitable for holding a supply of tape flags 2130. In a preferred version of the housing 2100, the chamber 2125 is dimensioned to hold a rolled or folded stack 2130 of approximately 35 tape flags. Disposed on the surface of cylindrical shell 2120 is a wide slot 2140, with a width substantially larger than in the embodiment depicted in FIG. 20. Slot 2140 is preferably aligned in an axial direction. This slot 2140 is sufficiently wide to allow a folded supply of tape flags 2130 to be inserted through the slot 2140. Thus, in refillable implementations of the writing instrument or tape-flag dispenser, the supply of tape flags 2130 can be reloaded through slot 2140—that is, reloaded in a radial direction.

To obtain a tape flag from housing 2100, a user grasps a flag from a back portion of folded stack 2130 and withdraws the flag through slot 2140. Folded stack 2130 is preferably configured so that once a first tape flag is obtained in this manner, subsequent tape flags are released in sequence. That is, one after another, free ends of successive tape flags protrude through slot 2140 after their predecessors have been withdrawn, facilitating the grasping of tape flags by the user.

Figure 22:
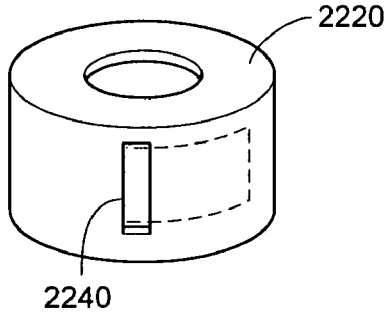
FIGS. 22, 23, and 24 illustrate some various embodiments of pre-packaged sheet material holders.
Figure 23:
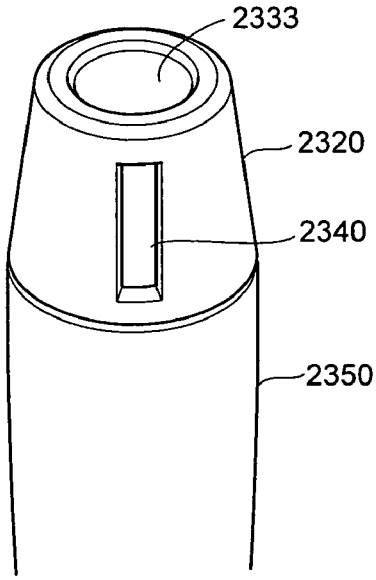
Figure 24:
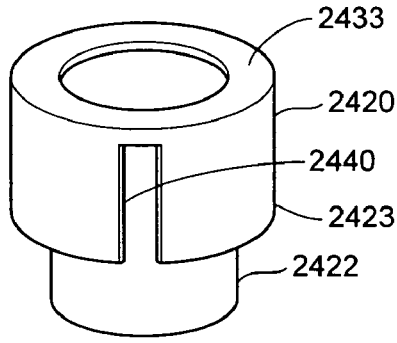

FIGS. 22, 23, and 24 illustrate pre-packaged tape-flag holders that can be used with a highlighter or other writing instrument, such as the embodiments of writing instruments discussed above. In general, as shown in FIG. 22, a pre-packaged unit has a containing shell 2220 dimensioned to hold a supply of tape flags. A slot 2240 is provided in the shell 2220, and configured so that tape flags can be issued through the slot 2240 from the supply of tape flags in the shell 2220.

FIG. 23 depicts one of the various possible articulations of a pre-packaged tape-flag holder that can be attached to a writing instrument, such as previously described, for example, with respect to FIGS. 1-4, 9-15, and 18-22. This tape-flag holder has a shell 2320 that is made of a two piece construction, including an upper shell section 2320 and a lower shell section (not visible in this drawing). The upper shell section 2320 fits over and covers the lower shell section. When fitted together, the upper and lower shell sections form a closed chamber into which a supply of tape flags can be stored. A slot 2340 is provided in the upper shell section 2320. Tape flags can be drawn through slot 2340 from the supply of tape flags in the chamber. The lower shell section has a nub or other structure that enables the holder to be attached to a writing instrument 2350. A recess 2333 is preferably provided on the upper shell section 2320 for attaching a writing-instrument cap (not shown) when the writing instrument is in use.

FIG. 24 illustrates one alternative articulation of the pre-packaged tape-flag holder—formed of a single unit 2420. The unit 2420 has an inner stem 2422 attached to an upper shell 2423. A slot 2440 is provided in upper shell 2423. Inner stem 2422 has a nub or other structure that enables the holder to be attached to a writing instrument. Inner stem 2422 and upper shell 2423 are positioned so that a space is provided around the inner stem 2422 and within the upper shell 2423. The inner stem 2422 and upper shell 2423 are dimensioned so that the space therebetween can hold a supply of tape flags, such as a folded stack of tape flags. The slot 2440 provided in upper shell 2423 allows individual flags can be drawn from the supply of tape flags. A recess 2433 is preferably provided on the upper shell 2423 for attaching a writing-instrument cap (not shown) when the writing instrument is in use.

The pre-packaged tape-flag holder of FIGS. 23 and 24 can be made with or without cosmetic shaping. For example, as shown by upper shell section 2320 and writing instrument 2350 in FIG. 23, the shape of upper shell section 2320 can be chosen to match and blend with the shape of the writing instrument 2350. In the alternative, as exemplified by unit 2420, the pre-packaged tape-flag holder can be constructed in a generic shape, without regard to the shape of a particular writing instrument.

Figure 25:
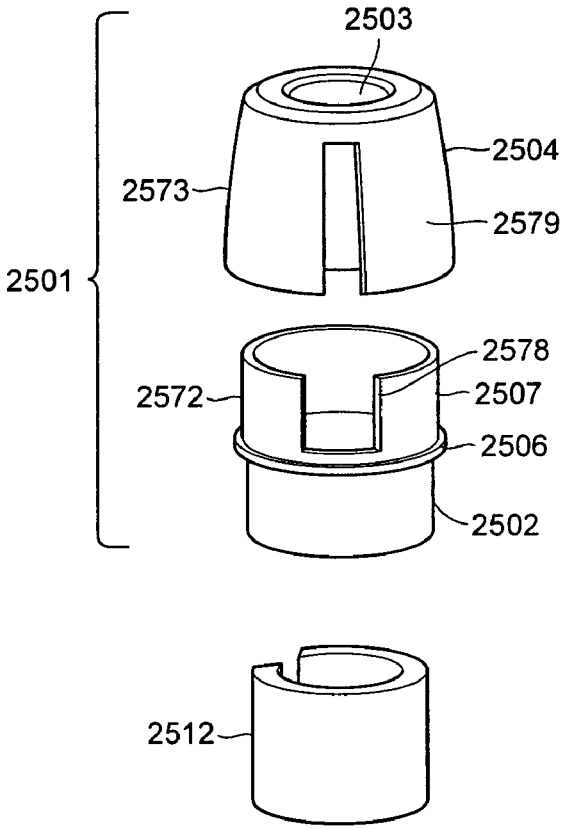
FIG. 25 depicts an embodiment of a two-piece sheet material cartridge.

FIG. 25 depicts an embodiment of a two-piece flag cartridge 2501 that can be used with or as part of a writing instrument, such as the embodiments of writing instruments discussed above. In this embodiment, a flag cartridge 2501 includes a cartridge cap 2573, a cartridge base 2572, and a supply of tape flags 2512. Cartridge cap 2573 has a tapered outer shell 2504 that is open at one end, and closed at the other end by a recess 2503. An outer slot 2579 is located on outer shell 2504, and extends to the edge of the open end of outer shell 2504. Cartridge base 2572 has a cylindrical-like inner shell 2507, an end cover 2506, and a supporting insert 2502. Supporting insert 2502 is mounted on end cover 2506. End cover 2506 is also attached to a first end of inner shell 2507, and closes off that first end of inner shell 2507. An opposing end of inner shell 2507 is open.

Flag cartridge 2501 can be attached to a highlighter by supporting insert 2502. The supporting insert is preferably dimensioned with an outer diameter that matches an inner diameter of the back end of a highlighter (such as circular opening 2871 indicated in FIG. 28 below). Thus, supporting insert 2502 can be inserted into the back end of a highlighter.

Inner shell 2507 has an outer diameter that is equal to or smaller than the inner diameter of outer shell 2504. Thus, the open end of inner shell 2507 can be fit into the open end of outer shell 2504, forming an enclosure for tape flags. The diameters of outer and inner shells 2504 and 2507 are selected so that the enclosure for tape flags has appropriate dimensions to hold the supply of tape flags 2512. Further, these diameters are preferably chosen so that outer and inner shells 2504 and 2507 fit securely together, but are readily separated for refilling.

An inner slot 2578 is disposed on inner shell 2507 at a location that can match the placement of outer slot 2579 on outer shell 2504. Thus, when outer and inner shells 2504 and 2507 are fit together, outer slot 2579 is located over inner slot 2578, thereby creating a slot that communicates into the enclosure for tape flags.

With cartridge cap 2573 separated from cartridge base 2572—that is, with the flag cartridge "open"—the supply of tape flags 2512 can be inserted into the inner shell 2507 of cartridge base 2572, with a leading tape flag extending through inner slot 2578. Inner shell 2507 can then be inserted into outer shell 2504 to "close" flag cartridge 2501.

Figure 26:
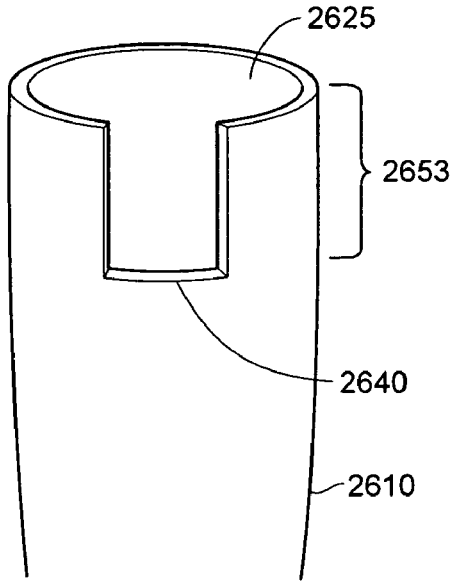
FIG. 26 illustrates one version of a sheet material cartridge formed onto the end of a writing instrument.

FIG. 26 illustrates one version of a flag cartridge formed onto the end of a writing instrument. A body section 2610 of a writing instrument can be created with a flag chamber 2625 formed into an end portion 2653 of the body section 2610. The end portion 2653 is formed with a slot 2640 through which tape flags can be issued from the flag chamber 2625. The end portion is preferably formed so that a cover, such as cartridge cap 2573 from FIG. 25, can be attached to close the flag chamber 2625.

As noted above, various embodiments of a flag dispenser can be formed or attached onto the end or onto the body of a writing instrument. A further design choice involves the use of a rotating or sliding cap to cover or uncover a slot through which tape flags are dispensed. Such an adjustable cover can also be used to cover or uncover a tape flag protruding from a slot in the flag dispenser.

Figure 27:
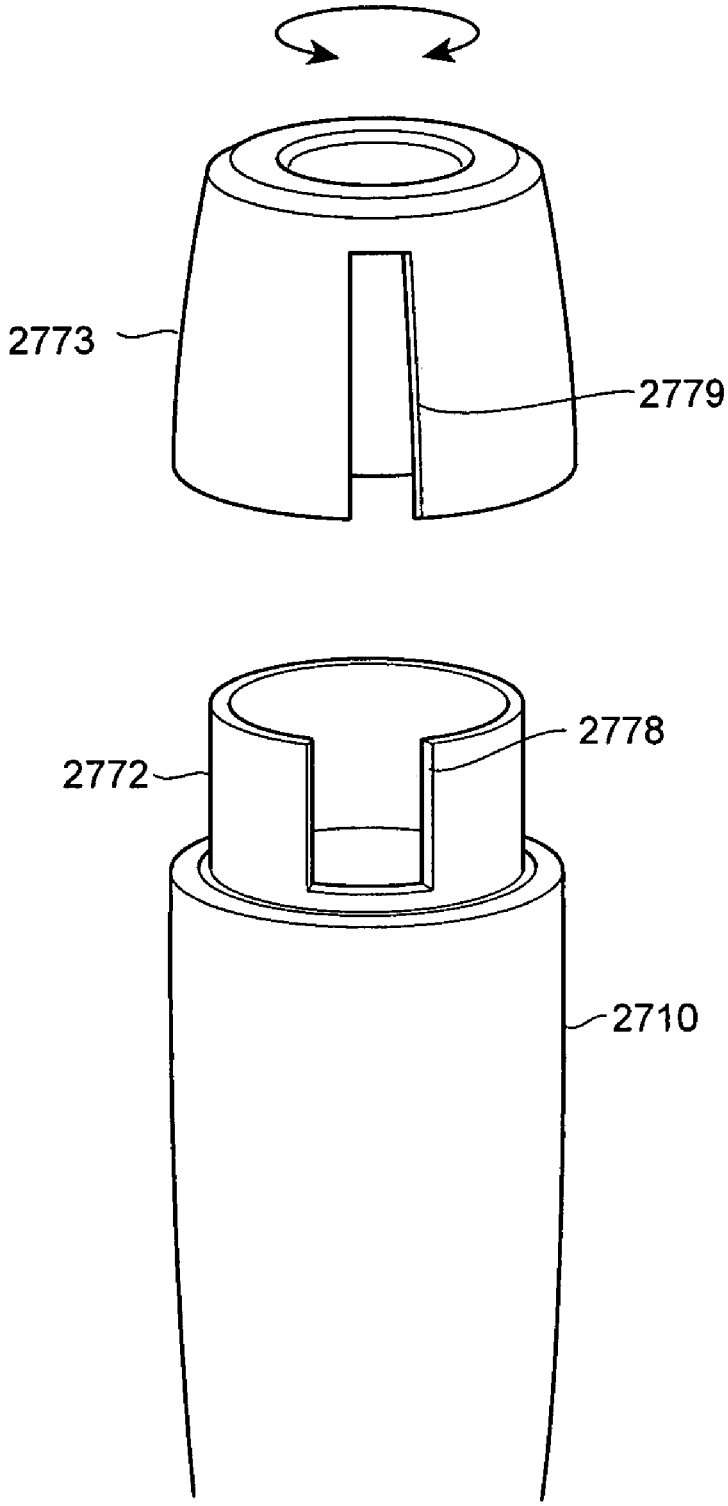
FIG. 27 shows an embodiment of a sheet material dispenser with a cap that rotates.

FIG. 27 shows an embodiment of a flag dispenser with a cap that rotates. This dispenser has a rotating cap 2773 and a base 2772. The rotating cap 2773 and the base 2772 fit together to form a chamber for holding a supply of tape flags. Rotating cap 2773 may be affixed to base 2772, for example, with interlocking grooves and ridges (not shown) formed on an inner surface of cap 2773 and on an outer surface of base 2772. Alternatively, the cap 2773 and base 2772 may be formed with matching threads (not shown) that allow cap 2773 and base 2772 to be screwed together.

An outer slot 2779 is provided in cap 2773, and an inner slot 2778 is provided in base 2772. Slots 2778 and 2779 can be aligned so that tape flags can be removed from the supply of tape flags inside the chamber. Outer slot 2779 is preferably made narrow so that tape flags protruding from the flag dispenser are held in place, and inner slot 2778 is preferably made wide so that the dispenser can be easily refilled.

In the depicted embodiment, cap 2773 is formed in a way that allows rotation when cap 2773 is fit onto base 2772. One position of cap 2773 aligns inner and outer slots 2778 and 2779. In this position of cap 2773, tape flags can be issued through the slots. Another position of cap 2773 mis-aligns inner and outer slots 2778 and 2779. In this position of cap 2773, the chamber holding a supply of tape flags is shut closed, and tape flags cannot be issued through the slots. This position preferably also locks or conceals the end of any tape flag protruding through inner slot 2778.

As discussed above, the base of flag dispenser can be formed onto a free-standing unit adapted for attachment to a writing instrument. Alternatively, a base can be formed directly onto the end of a writing instrument, as illustrated by the embodiment depicted in FIG. 27. In this embodiment, base 2772 is formed onto the end of the body 2710 of a writing instrument.

Figure 28:
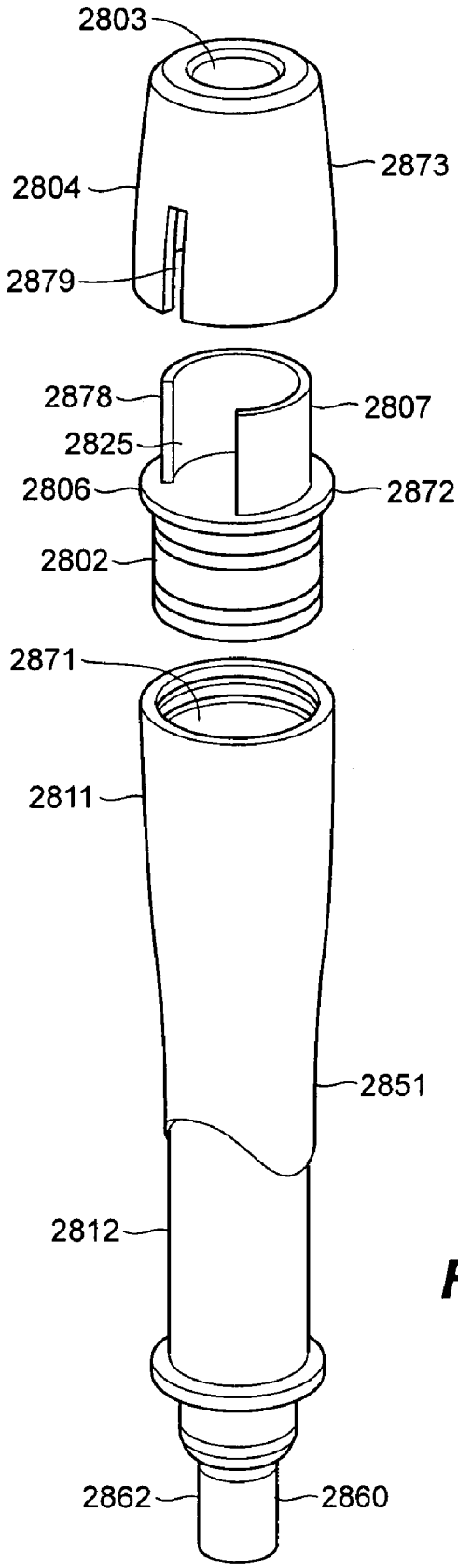
FIGS. 28 and 29 illustrate a connectable combination of a writing instrument and a sheet material dispenser.
Figure 29:
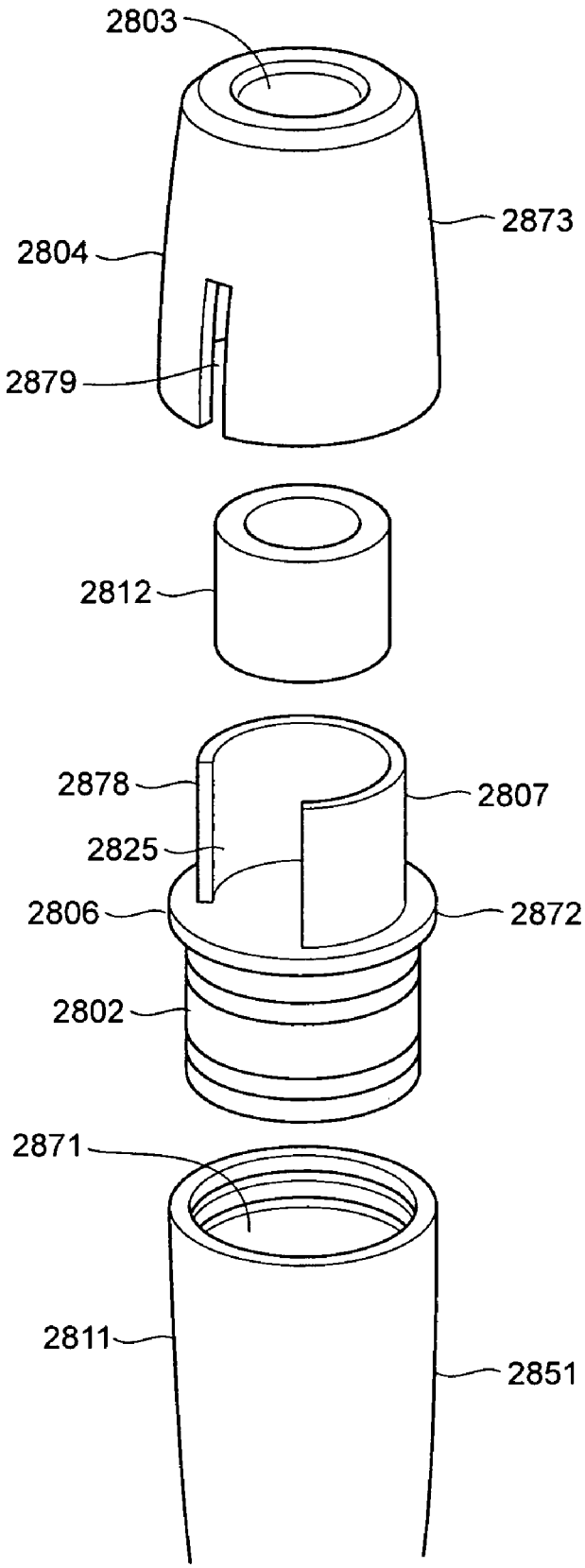

FIGS. 28 and 29 illustrate yet another technique for connecting a flag dispenser to a writing instrument. In these figures, a highlighter and flag dispenser have separable parts preferably formed of injection-molded plastic, including: a body portion 2851, a cap 2860, a plug 2872, and a rear cap 2873. Body portion 2851 as shown has a substantially tubular or cylindrical shape, with a back end 2811 and a front end 2812. A writing tip (not shown) is mounted on body portion 2851 at front end 2812. Cap 2860 is attached (but removable) to front end 2812, and preferably includes a nub 2862. The back end 2811 has a circular opening 2871 into which plug 2872 can be affixed.

Plug 2872 has several connected portions, including an insertion cylinder 2802, an end cover 2806, and a cylindrical-like inner shell 2807. An axially-aligned inner slot 2878 is provided in inner shell 2807. Insertion cylinder 2802 has an outer diameter that corresponds to an inner diameter of circular opening 2871 of body portion 2851: the insertion cylinder 2802 is dimensioned to fit snugly into circular opening 2871, thereby affixing plug 2872 to body portion 2851.

End cover 2806 is connected to insertion cylinder 2802, and closes the body portion 2851 of the writing instrument when plug 2872 is affixed to body portion 2851. Inner shell 2807 is formed on end cover 2806. Within inner shell 2807 is a chamber 2825 that has dimensions suitable for holding a supply of tape flags 2912 (depicted n FIG. 29).

Rear cap 2873 generally has the shape of a short hollow cylinder closed at one end. Rear cap 2873 has a tapered outer shell 2804, on which is provided an outer slot 2879 aligned in an axial direction. Closing one end of outer shell 2804 is a cover with a recess 2803, which is preferably dimensioned to clasp cap 2860 by nub 2862.

An inner radius of outer shell 2804 is matched to an outer radius of inner shell 2807: the outer shell 2804 is dimensioned to fit snugly onto inner shell 2807, thereby affixing rear cap 2873 to plug 2872.

With rear cap 2873 thus affixed to plug 2872, chamber 2825 is fully enclosed except for an opening formed by the overlap of inner and outer slots 2878 and 2879. Through these slots tape flags can be drawn form a supply of tape flags stored in chamber 2825.

FIG. 29 is a close-up view of elements from FIG. 28. This drawing highlights (1) body portion 2851 with back end 2811 and circular opening 2871; (2) plug 2872 with insertion cylinder 2802, end cover 2806, inner shell 2807, chamber 2825, and inner slot 2878; and (3) rear cap 2873 with outer shell 2804, outer slot 2879, and recess 2803. Also depicted is (4) a supply of tape flags 2812, which fits into chamber 2825.

Tape-flag dispensers attached to writing instruments need not have fully enclosed chambers. Sides and portions of the top of a chamber can be left uncovered, so long as the supply of tape flags held by the dispenser are securely held in the chamber.

Figure 30:
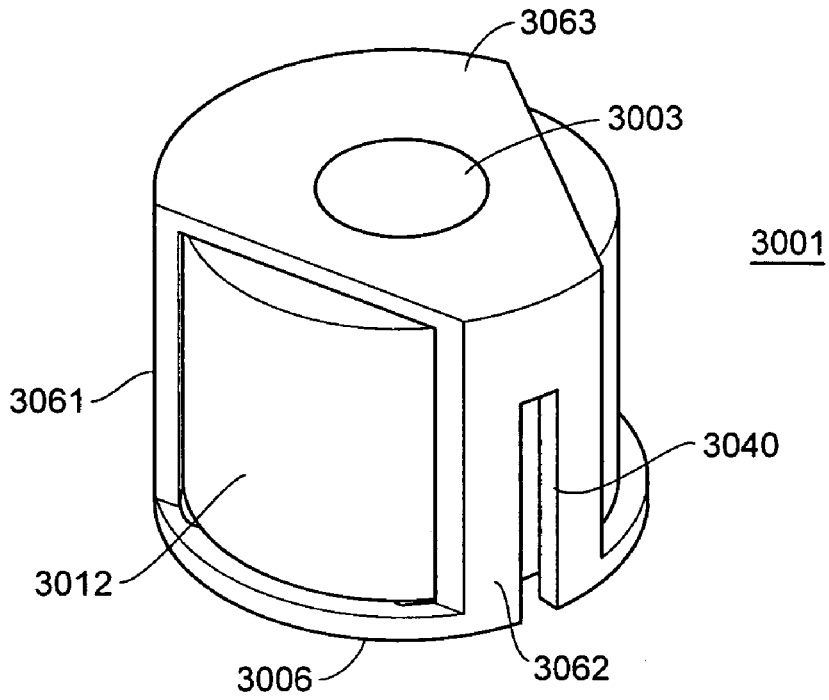
FIGS. 30 and 31 are schematic diagram representations of some various embodiments of a partially open sheet material dispenser.

FIG. 30 shows a partially open tape-flag dispenser 3001 that can be joined with (by a nub-recess connection, not shown) or formed onto the end of a highlighter or other writing instrument, such as those shown in FIGS. 1-4. The dispenser 3001 has a bottom wall 3006, a back wall 3061, a front wall 3062, and a top wall 3063. A slot 3040 is provided in front wall 3062. The walls 3006, 3061, 3062, and 3063 are connected together to form a chamber within. The chamber has one or more open sides. Additionally, the chamber can have a partially open bottom and top.

A supply of tape flags 3012 can be held by dispenser 3001. The supply of tape flags 3012 can preferably be inserted into dispenser 3001 through one or more openings in dispenser 3001. Dispenser 3001 preferably has a recess 3003 formed into the top wall 3063. Recess 3003 can be used to hold a cap (such as cap 220 from FIGS. 3 and 4) when the writing instrument is in use.

Figure 31:
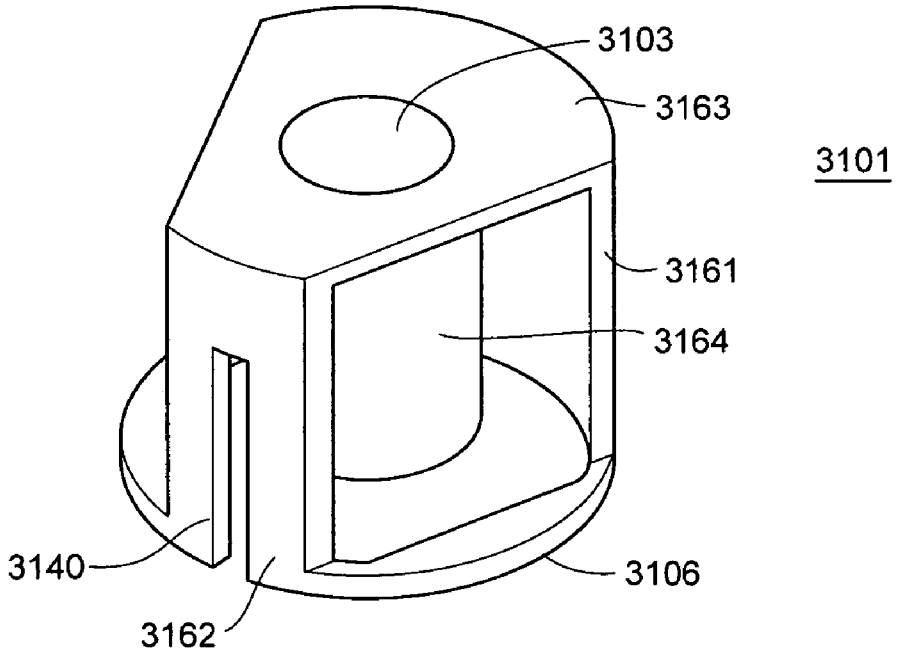

FIG. 31 shows another embodiment of a partially open tape-flag dispenser 3101 that can be joined with the end of a highlighter or other writing instrument, such as those shown in FIGS. 1-4, by inserting a nub (not shown) of the dispenser 3101 into a recess of the highlighter. Alternatively, dispenser 3101 can be integrally formed onto the end of a highlighter or other writing instrument. The dispenser 3101 includes a central spindle 3164 for supporting a supply of tape flags (not shown). As with the embodiment shown in FIG. 30, dispenser 3101 has a bottom wall 3106, a back wall 3161, a front wall 3162, and a top wall 3163. A slot 3140 is provided in front wall 3162. The walls 3106, 3161, 3162, and 3163 are connected together to form a chamber within. The chamber has one or more open sides. Additionally, the chamber can have a partially open bottom and top.

A supply of tape flags (not shown) can be held by dispenser 3101. The supply of tape flags can preferably be inserted into dispenser 3101 through one or more openings in dispenser 3101. Dispenser 3101 preferably has a recess 3103 formed into the top wall 3163. Recess 3103 can be used to hold a cap (such as cap 220 from FIGS. 3 and 4) when the writing instrument is in use.

As discussed above, a variety of designs are contemplated for the supply of tape flags that are stored in the various embodiments of the writing instrument. In addition to rolls, stacks, rolled stacks, and folded stacks of tape flags, the supply of tape flags can also be implemented as a paper roll on which separate tape flags have been affixed. Such designs are shown in FIGS. 32-38.

Figure 32:
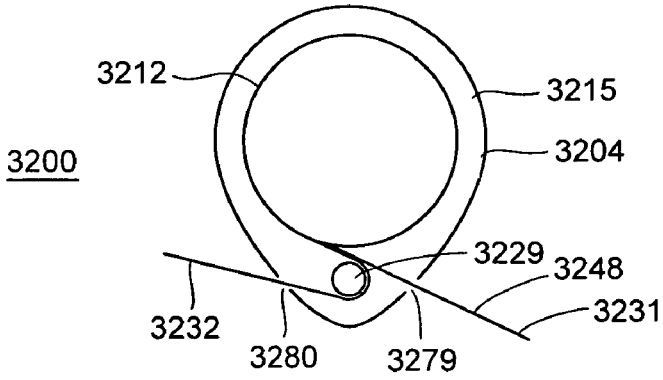
FIGS. 32 and 33 show one embodiment of a dispenser for a supply of tape flags mounted on a roll of paper backing.

FIG. 32 is a top-view cross section of a dispenser 3200 for a supply of tape flags mounted on a roll of paper backing. In this depiction, dispenser 3200 has a shell 3204, an axially mounted rod 3229, and a supply roll 3212 of tape flags mounted on paper backing. The shell 3204 encloses a tape-flag chamber 3215 and has two slots: one slot 3279 for removing tape flags and another slot 3280 for removing the paper backing. In the supply roll 3212, separate tape flags are mounted on a roll of disposable paper backing. During use, the tape flags are drawn from supply roll 3212, and are pulled across rod 3229 towards flag slot 3279, through which the tape flags can be removed. One tape flag 3231 is shown issuing through the flag slot 3279.

The disposable paper backing is similarly drawn from supply roll 3212, but is then wrapped back around rod 3229, separating the paper backing from the tape flags. The paper backing then issues through the backing slot 3280. A stem of paper backing 3232 is shown extending through the backing slot 3280.

To obtain tape flags, a user pulls on an end of paper backing 3232 protruding from backing slot 3280. The tension applied to the paper backing causes supply roll 3212 to rotate within chamber 3215 so that more paper backing advances away from the supply roll 3212 and around rod 3229. As the paper backing is drawn in a tight radius around rod 3229, a leading non-adhesive portion 3248 of a tape flag becomes separated from the paper backing. As the paper backing is further drawn around rod 3229, the tape flag becomes further separated from the paper backing and is projected towards and through flag slot 3279. The user can then grasp and remove the protruding tape flag 3231 by non-adhesive portion 3248.

Figure 33:
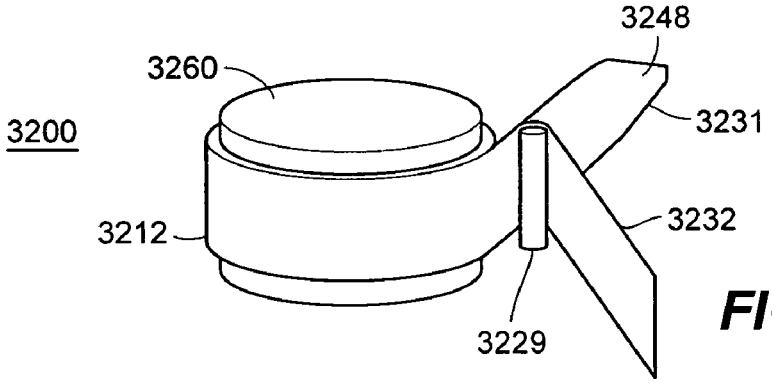

FIG. 33 further illustrates the structure of dispenser 3200 from FIG. 32. This figure shows the dispenser without shell 3204, so that the other components can be more clearly depicted. In this depiction, supply roll 3212 is mounted on an optional support core 3260. This illustration shows paper backing 3232 being drawn tightly around rod 3229 so that a leading tape flag 3231 is separated from the paper backing 3232.

Figure 34:
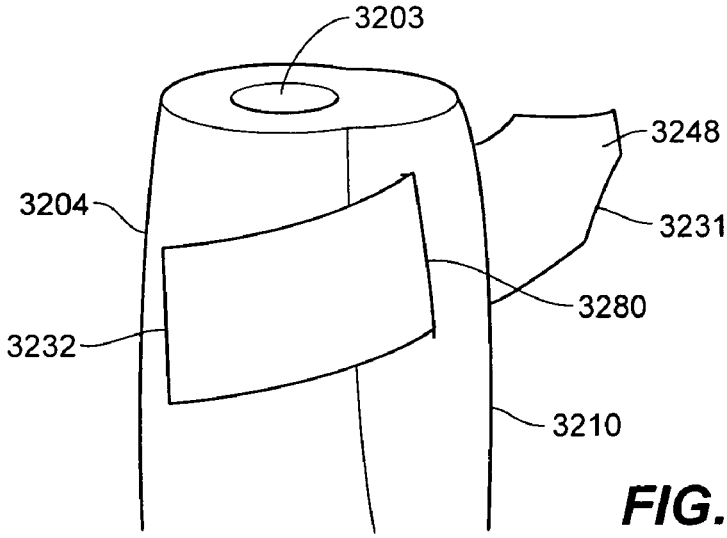
FIG. 34 shows one embodiment of a writing instrument that dispenses tape flags mounted on a roll of paper backing.

FIG. 34 shows one implementation of the dispenser 3200 from FIG. 32 or FIG. 33 as incorporated into the body 3210 of a writing instrument. A rear portion of the writing instrument body 3210 composes shell 3204. An end of paper backing 3232 extends through backing slot 3280 in shell 3204, and a leading tape flag 3231 extends through flag slot 3279 (not visible in this view). By grasping the writing instrument body 3210 with one hand and pulling the end of paper backing 3232 with another hand, a user can obtain the tape flag 3231 from the flag slot 3279.

A spectrum of variations are contemplated for the mechanism exemplified by dispenser 3200 of FIGS. 32 or 33. For example, instead of paper, various other materials, such as plastic films, may be employed in the paper backing 3232 of supply roll 3212. Support core 3260 can be made as a solid cylinder, a hollow tube, or a hollow cylinder, or even of a non-round shape. Support core 3260 can be formed of paper, plastic, or cardboard, among other material. One end of the writing instrument body 3210 preferably includes a recess 3203 that is dimensioned to conveniently hold a writing cap (such as cap 220 from FIG. 3). Still further, dispenser 3200 can be integrated into a disposable or removable unit, as was discussed for example with respect to FIGS. 1-4 and 9-15.

Figure 35:
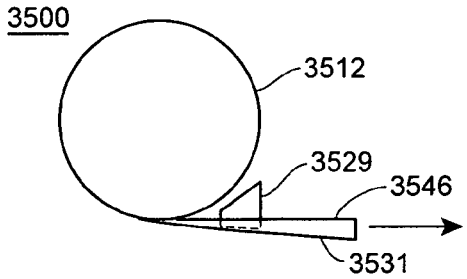
FIGS. 35 and 36 show another embodiment of a dispenser for a supply of tape flags mounted on a roll of paper backing.
Figure 36:
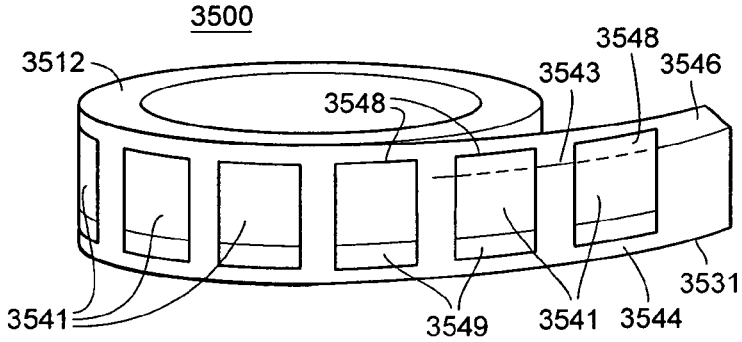

FIG. 35 is a top-view cross section of another dispenser 3500 for a supply of tape flags mounted on a roll of paper backing, and FIG. 36 is another view of dispenser 3500. These depictions shows a supply roll 3512 of tape flags and a wedge 3529. In the supply roll 3512, separate tape flags 3541 are mounted on a roll of disposable paper backing 3544. Unlike supply roll 3212 from FIG. 32 (in which tape flags were aligned with non-adhesive portions towards the end of the supply roll 3212), in supply roll 3512 tape flags are aligned with their non-adhesive portions 3548 towards one edge of the supply roll 3512, and with their adhesive portions 3549 towards an opposite edge of the supply roll 3512.

Wedge 3529 is used to form a crease 3543 in a leading end 3531 of paper backing 3544 as the backing is drawn from the supply roll 3512. As the paper backing is creased, a folded section 3546 of the paper backing 3544 is folded away from the non-adhesive portions 3548 of tape flags 3541. Thus, this folding separates the folded section 3546 of the paper backing from the non-adhesive portions 3548 of tape flags 3541, while leaving the adhesive portions 3548 attached to the paper backing 3544. This separation makes the tape flags 3541 ready for grasping by a user.

Figure 37:
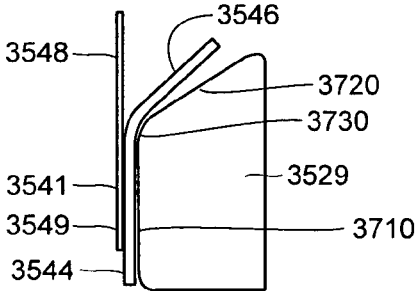
FIG. 37 is a cross-sectional view of a wedge used in the dispenser of FIGS. 35 and 36.

FIG. 37 is a side-view cross section of tape flags being drawn across wedge 3529. Wedge 3529 has a vertical surface 3710 that is parallel to the alignment of the tape flags 3541 and paper backing 3544 in supply roll 3512. Additionally, wedge 3529 has an angled surface 3720 that is formed at an angle from vertical surface 3710. A corner 3730 is formed at the intersection of the vertical and angled surfaces 3710 and 3720.

FIG. 37 also shows a cross-section of paper backing 3544 and tape flag 3541 being drawn across the vertical surface 3710 of wedge 3529. With an appropriate grip supplied by a user, tension in paper backing 3544 folds paper backing 3544 over the corner 3730 of wedge 3529, so that the folded section 3546 of the paper backing 3544 is pulled away from the non-adhesive portions 3548 of tape flags 3541. The adhesive portions 3549 remain attached to the paper backing 3544. The non-adhesive portions 3548 are then easily grasped by a user so that the tape flags 3541 can be completely peeled away from the paper backing 3544.

Figure 38:
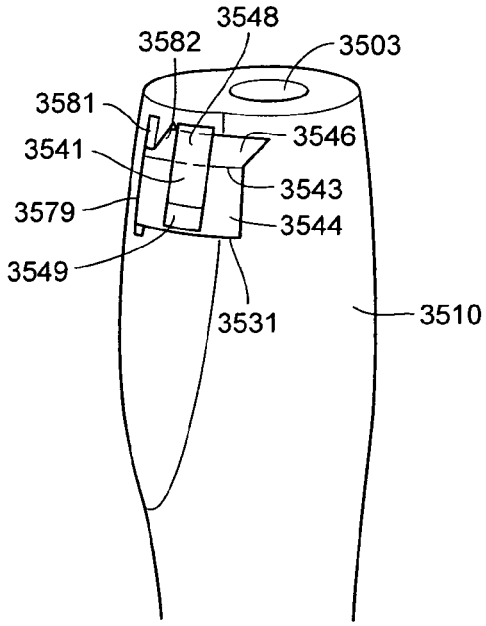
FIG. 38 shows another embodiment of a writing instrument that dispenses tape flags mounted on a roll of paper backing.

FIG. 38 shows one implementation of dispenser 3500 from FIG. 35 as incorporated into the body 3510 of a writing instrument. A rear portion of the writing instrument body 3510 houses dispenser 3500. The end 3531 of the paper backing extends through a slot 3579 in body 3510. This view shows the folded section 3546 of paper backing 3544 being folded away from the non-adhesive portions 3548 of tape flags 3541.

By grasping the writing instrument body 3510 with one hand and pulling the end of paper backing 3531 with another hand, a user can obtain the tape flags 3541 from the slot 3579. Tape flags 3541 can then be easily peeled from paper backing 3544, and the extending expended portion of paper backing 3544 can be tom off and discarded by the user.

Slot 3579 preferably has two extensions 3581 and 3582 as shown in FIG. 38. One of these extensions 3581 is straight and collinear with the main portion of slot 3579. Tape flags can be drawn, if desired, without folding through slot 3579 and straight extension 3581. Another extension 3582 is angled away from the main portion of slot 3579, matching the angled surface 3720 of wedge 3529. Tape flags can be drawn, if desired, through slot 3579 and angled extension 3582 to assist with the folding operation around wedge 3529.

The combination writing instrument-flag dispenser illustrated in FIG. 38 can be modified with a number of variations. For example, instead of paper, various other materials may be employed in the paper backing 3544, such as a plastic film. Supply roll 3512 can be made with or without a support core. An optional recess 3503 in writing instrument body 3510 can be provided to conveniently hold a writing cap (such as cap 220 from FIG. 3). Still further, the dispenser 3500 can be integrated into a disposable or removable unit, as was discussed for example with respect to FIGS. 1-4 and 9-15. Further, it is noted that tape-flag dispensers attached to writing instruments need not have fully enclosed chambers. Sides and portions of the top of a chamber can be left uncovered, so long as the supply of tape flags held by the dispenser are securely held in the chamber.

Figure 39:
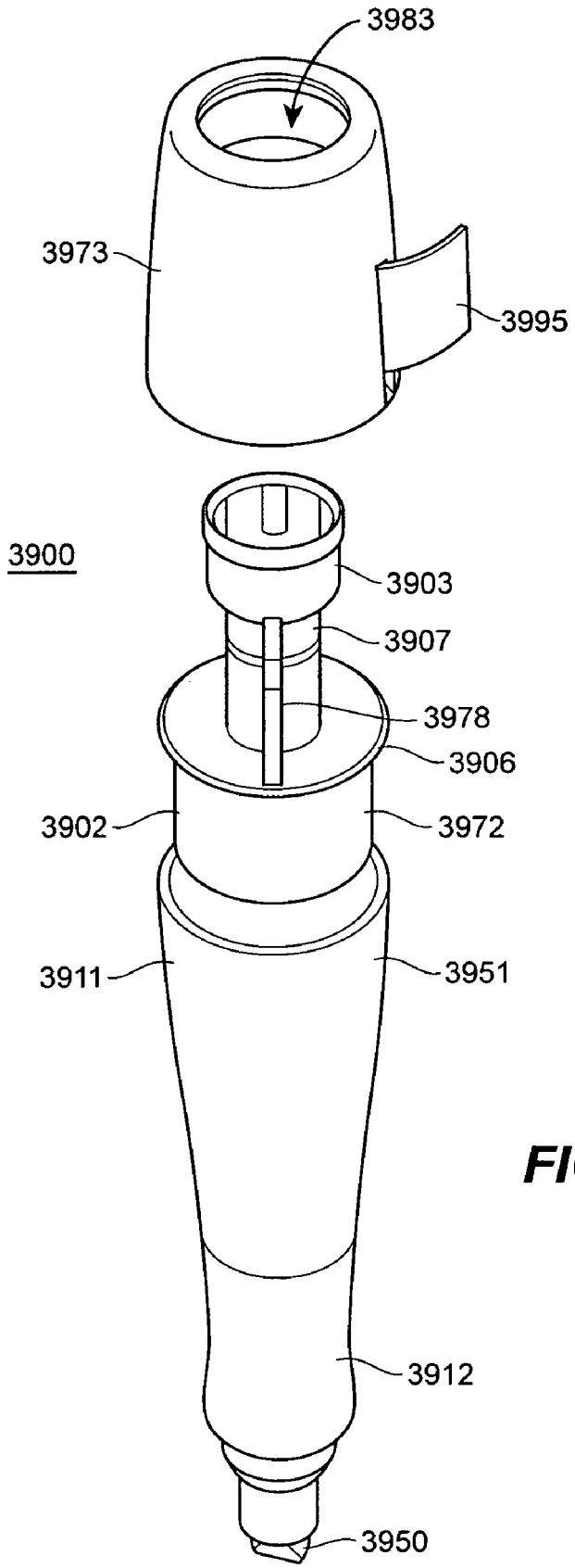
FIGS. 39, 40, and 41 illustrate yet another technique for connecting a sheet material dispenser to a writing instrument.
Figure 40:
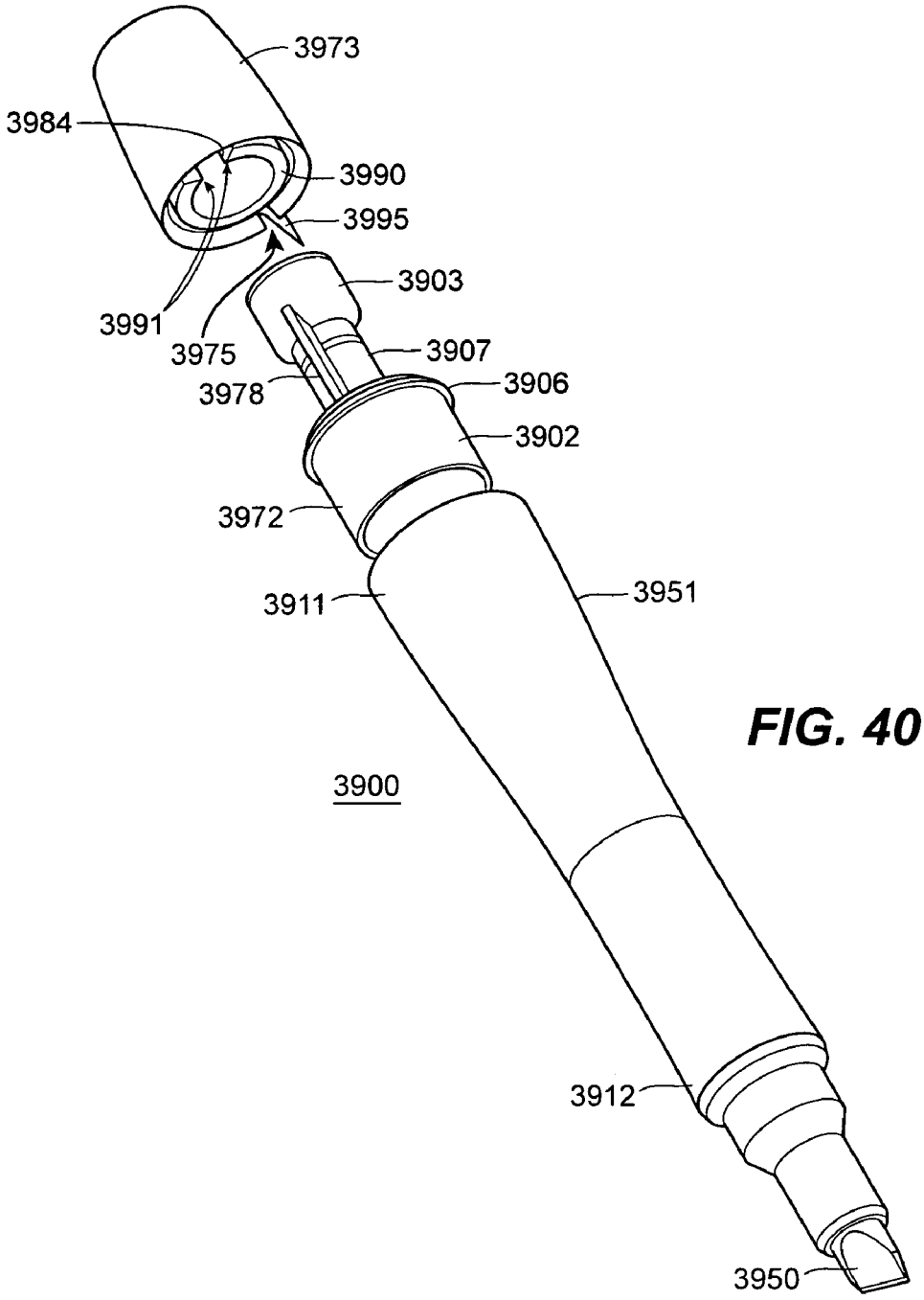
Figure 41:
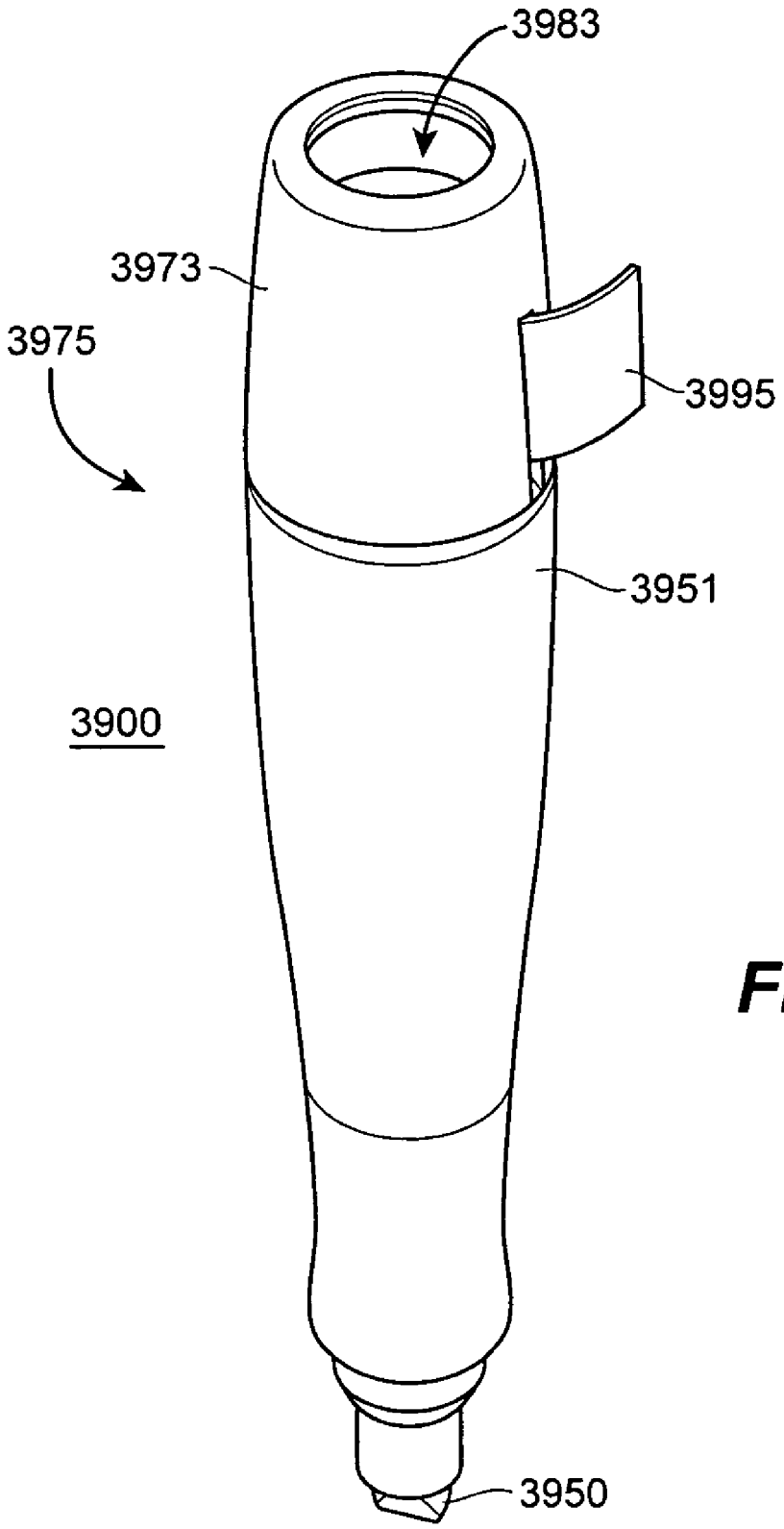

FIGS. 39, 40, and 41 illustrate yet another technique for connecting a flag dispenser to a writing instrument 3900. The writing instrument 3900 has parts preferably formed of injection-molded plastic, including: a body portion 3951, a plug 3972, and a cover cartridge 3973. Plug 3972 is preferably permanently attached onto body portion 3951. This attachment may be by adhesive, by heat treatment, or by press fitting with or without interlocking rings and ridges.

Body portion 3951 has a front end 3912 that holds a marking element 3950, and a back end 3911 adapted to connect with plug 3972. Body portion 3951 is preferably dimensioned to be readily gripped by a user's hand.

Cover cartridge 3973 has a cylinder-like shape with two openings on the ends: a front opening 3984 and a back opening 3983. Cover cartridge 3973 holds a supply of tape flags 3990. To assist a user in determining how many flags are remaining in the supply 3990, cover cartridge 3973 may be made of a transparent material. The supply of tape flags 3990 may be a folded stack of tape flags, as discussed above. The tape flags 3990 are held within the interior of cover cartridge 3873 by friction between the flags and the interior wall of cover cartridge 3973. Bumps, protrusions, tabs, ledges, and nubs (not shown) may be added near the lower end of the interior of cover cartridge 3973 to provide additional support. When folded, the supply of tape flags 3990 has a gap between the folded ends 3991 of the stack of tape flags. An end of a tape flag 3995 is shown protruding from an dispenser opening 3975 in cover cartridge 3973.

Plug 3972 includes a spindle 3907, an end cover 3906 attached to one end of spindle 3907, a cap holder 3903 attached to the opposing end of spindle 3907, and a plug wall 3978 attached to the length of spindle 3907. The plug 3972 is dimensioned so that the supply of tape flags 3990 fits around spindle 3907, and the plug wall 3978 is located between the gap formed between the ends 3991 of the supply of tape flags 3990. The plug wall 3978 thus separates the folded ends 3991. Plug 3972 may be further dimensioned so that the supply of tape flags 3990 is held fixed with respect to plug 3972, fixed from rotating by the plug wall 3978, and held in a folded shape by the cover cartridge 3973.

Plug 3972 preferably also includes an insertion cylinder 3902 connected to end cover 3906. Insertion cylinder 3902 has a shape that corresponds to the shape of an opening in back end 3911 of body portion 3951. The insertion cylinder 3902 is dimensioned to be inserted into back end 3911 until end cover 3906 contacts the rear edge of back end 3911, thereby affixing plug 3972 to body portion 3951.

Plug 3972 is preferably fixed permanently into back end 3911, so that plug 3972 and back end 3911 may not be separated by a user. This permanent attachment may be achieved, for example, by appropriately dimensioning plug 3972 and back end 3911 and press-fitting these components together. The fit may be augmented by interlocking ridges and grooves (not shown) on plug 3972 and inside back end 3911.

Cover cartridge 3973 is dimensioned to securely fit onto plug 3972, with a secure but removable connection between the cover cartridge 3973 and plug 3972. Plug 3972 fits into front opening 3984 of cover cartridge 3973. The fit between plug 3972 and cover cartridge 3973 may be a snap-fit, in which small grooves, tabs, and slots (not shown) on these components removeably engage with each another to hold the plug 3972 and cover cartridge 3973 together. Cover cartridge 3973 and plug 3972 are dimensioned so when attached together, these components'securely hold the supply of tape flags 3990, and tape flags may be readily drawn from the supply of tape flags 3990 through dispenser opening 3975 in cover cartridge 3973.

When attached to plug 3972, cover cartridge 3973 is preferably free to rotate in place. By rotating cover cartridge 3973, a user may retract a protruding end of a tape flag 3995 partly or completely into cover cartridge 3973, thus preparing the writing instrument 3900 for storage.

To prevent the protruding end of a tape flag 3995 from being completely retracted, plug 3972 and an inner surface of cover cartridge 3973 may each additionally be fitted with one or more stopper tabs (not shown) that engage one another to limit the extent that cover cartridge 3973 can rotate with respect to plug 3972. These stopper tabs may be specifically located so that the cover cartridge 3973 can rotate clockwise to a limit, and counterclockwise to a limit. This bi-directional limited rotation may be tailored to the dimensions of a stack of tape flags, whose zig-zag folding structure requires the cover cartridge 3973 to rotate in both directions.

An insert, such as cardboard or plastic insert (not shown), may be added to the bottom of cover cartridge 3973 to hold the supply of tape flags 3990 in place when the cover cartridge 3973 is not attached to the plug 3972. This insert may take the form of a flat disk that is dimensioned to snugly fit into front opening 3984 after the supply of tape flags 3990 has been placed into cover cartridge 3973. The insert has a central hole dimensioned to admit the spindle 3907 of plug 3972. The insert may be particularly useful in implementations of the writing instrument 3900 where the supply of tape flags 3990 and the cover cartridge 3973 are replaceable as a single unit. In implementations of the writing instrument 3900 where the supply of tape flags 3990 is a separately replaceable component, the insert may be omitted, thereby facilitating refilling or replacement of the supply of tape flags 3990.

Cap holder 3903 on plug 3972 includes a recess dimensioned to hold the nub of a cap (not shown) for writing instrument 3900. When cover cartridge 3973 is attached to plug 3972, cap holder 3903 is accessible through back opening 3983 of cover cartridge 3973. Thus, a cap with a nub (such as cap 220 shown in FIG. 3) is securely connected to writing instrument 3900 by inserting the nub through the back opening 3983 and snugly into the recess of the cap holder 3903 of plug 3972.

FIG. 41 is a view of writing instrument 3900 as assembled. Shown in this diagram are body portion 3951 with a marking element 3950, and cover cartridge 3973, with back opening 3983, dispenser opening 3975, and flag 3995 protruding through dispenser opening 3975.

Figure 42:
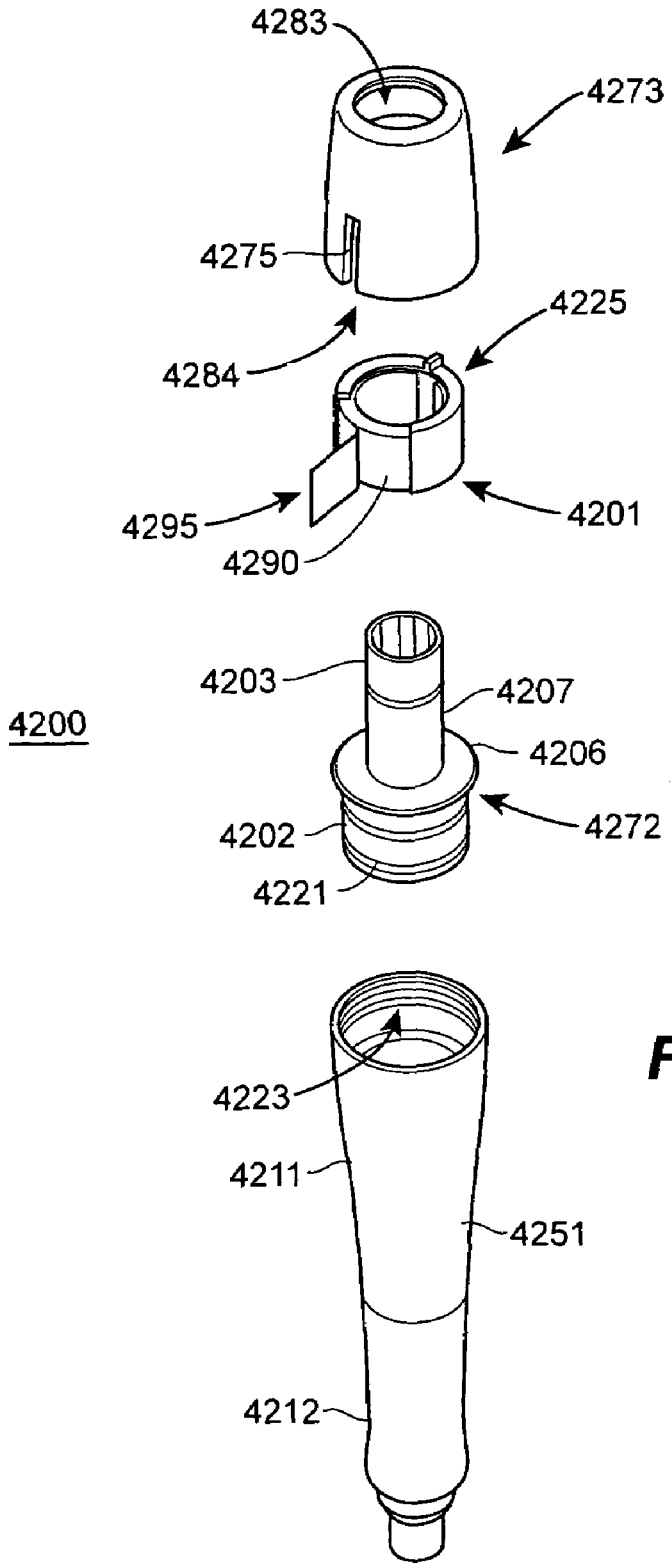
FIGS. 42 and 43 illustrate a further technique for connecting a sheet material dispenser to a writing instrument.
Figure 43:
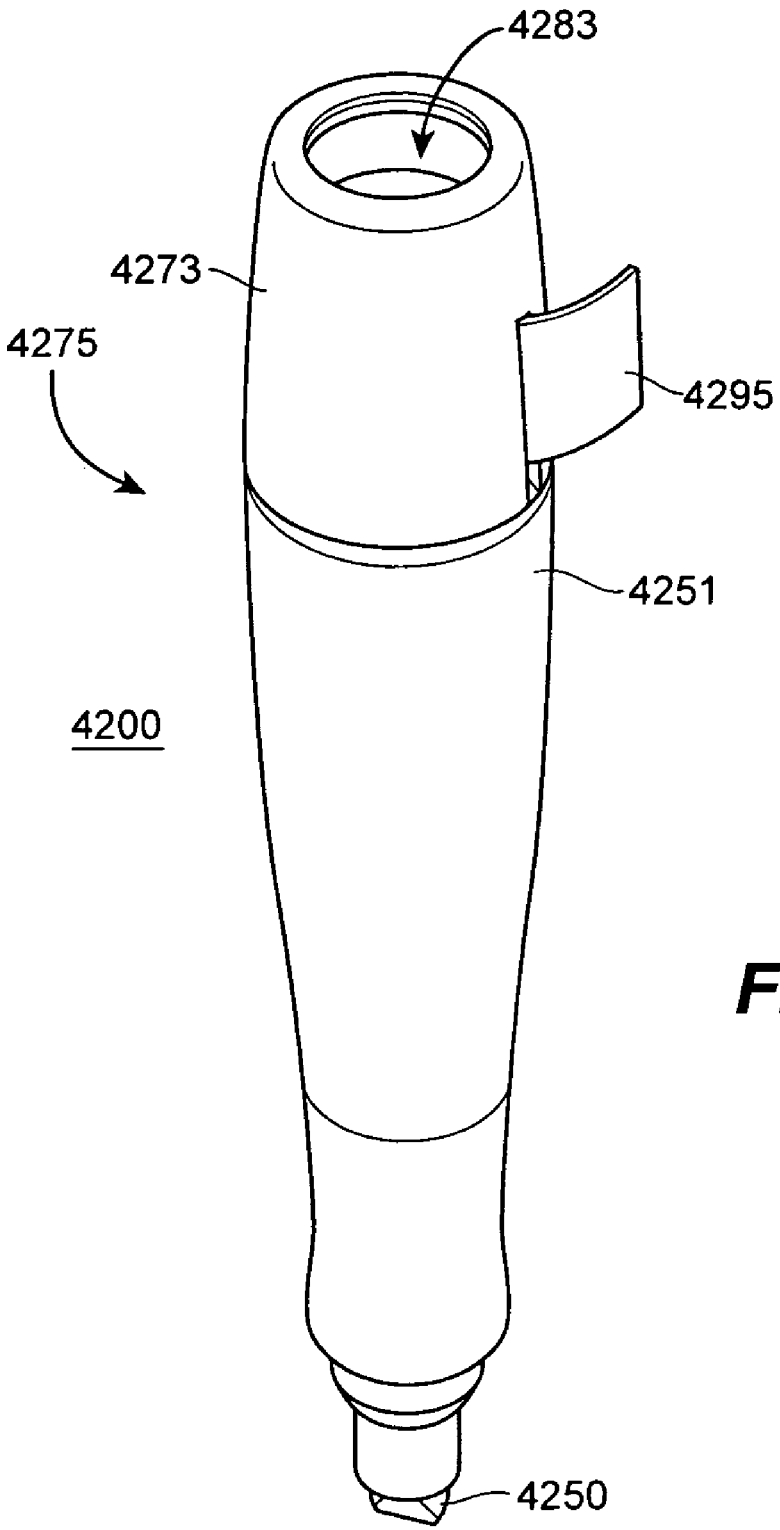

FIGS. 42 and 43 illustrate a further technique for connecting a flag dispenser to a writing instrument 4200. The writing instrument 4200 has parts preferably formed of injection-molded plastic, including: a body portion 4251, a plug 4272, a flag cartridge 4201, and a cover 4273. Plug 4272 is preferably permanently attached onto body portion 4251 in a manner similar to the attachment between plug 3972 and body 3951 of FIG. 39. This attachment may be by adhesive, by heat treatment, or by press fitting with or without interlocking rings and ridges.

Body portion 4251 has a front end 4212 and a back end 4211 adapted to connect with plug 4272. Body portion 4251 is preferably dimensioned to be readily gripped by a user's hand.

Cover 4273 has a cylinder-like shape with two openings on the ends: a front opening 4284 and a back opening 4283. Flag cartridge 4201 is dimensioned to fit into cover 4273 through front opening 4284. To assist a user in determining how many flags are remaining in flag cartridge 4201, cover 4273 may be made of a transparent material. Additionally, flag cartridge 4201 may also be made of a transparent material. Flag cartridge 4201 has an annular-like shape or C-shape with a gap formed to receive a supply of tape flags 4290. The supply of tape flags 4290 may be a folded stack of tape flags. An end of a tape flag 4295 is shown protruding through the gap in the flag cartridge 4201 and a dispenser opening 4275 in cover 4273.

Plug 4272 includes a spindle 4207, an end cover 4206 attached to one end of spindle 4207, and a cap holder 4203 attached to the opposing end of spindle 4207. The plug 4272 is dimensioned so that flag cartridge 4201, and thus the supply of tape flags 4290 in flag cartridge 4201, fit around spindle 4207.

Plug 4272 may include stopper tabs (not shown) so that flag cartridge 4201 is held fixed with respect to plug 4272. The stopper tabs prevent flag cartridge 4201 from rotating with respect to plug 4272. Alternatively, plug 4272 and flag cartridge 4201 may be configured so that flag cartridge 4201 is free to rotate around the spindle 4207 of plug 4272

Plug 4272 preferably also includes an insertion cylinder 4202 connected to end cover 4206. Insertion cylinder 4202 has a shape that corresponds to the shape of an opening in back end 4211 of body portion 4251: the insertion cylinder 4202 is dimensioned to fit into back end 4211, thereby affixing plug 4272 to body portion 4251. Plug 4272 is preferably fixed permanently into back end 4211, so that plug 4272 and back end 4211 may not be separated by a user. This permanent attachment may be achieved, for example, by appropriately dimensioning plug 4272 and back end 4211 and press-fitting these components together. The fit may be augmented by interlocking ridges and grooves 4221 and 4223 on plug 4272 and inside back end 4211.

Cover 4273 is dimensioned to securely fit onto plug 4272, with a secure: but removable connection between the cover 4273 and plug 4272. Plug 4272 fits into front opening 4284 of cover 4273. Cover 4273 and plug 4272 are dimensioned so when attached together, these components securely hold flag cartridge 4201, and tape flags may be readily drawn from the flag cartridge 4201 through dispenser opening 4275 in cover 4273.

When attached to plug 4272, cover 4273 is preferably free to rotate in place. By rotating cover 4273, a user may retract a protruding end of a tape flag 4295 partly or completely into cover 4273, thus preparing writing instrument 4200 for storage. To prevent the protruding end of a tape flag 4295 from being completely retracted, flag cartridge 4201 and an inner surface of cover 4273 may additionally be fitted with stopper tabs, such as a stopper tab 4225 on flag cartridge 4201 and one or more matching stopper tabs (not shown) on cover 4273 that engage to limit the extent that cover 4273 can rotate with respect to flag cartridge 4201. These stopper tabs may be specifically located so that the cover 4273 can rotate clockwise to a limit, and counterclockwise to a limit. This bi-directional limited rotation may be tailored to the dimensions of tape flags in a folded stack of tape flags, whose zig-zag folding structure requires the cover 4273 to rotate in both directions while tape flags are being dispensed.

An insert, such as cardboard or plastic insert (not shown), may be added to the bottom of cover 4273 to hold flag cartridge 4201 in place when the cover 4273 is not attached to the plug 4272. This insert may take the form of a flat disk that is dimensioned to snugly fit into front opening 4284 after flag cartridge 4201 has been placed into cover 4273. The insert has a central hole dimensioned to admit the spindle 4207 of plug 4272. The insert may be particularly useful in implementations of the writing instrument 4200 where the flag cartridge 4201 and cover 4273 are replaceable as a single unit. In implementations of the writing instrument 4200 where the flag cartridge 4201 is a refillable or separately replaceable component, the insert may be omitted, thereby facilitating refilling or replacement of the flag cartridge 4201.

Cap holder 4203 on plug 4272 includes a recess dimensioned to hold a cap (not shown) when writing instrument 4200 is being used for writing. When cover 4273 is attached to plug 4272, cap holder 4203 is accessible through back opening 4283 of cover 4273. Thus, a cap with a nub (such as cap 220 shown in FIG. 3) is securely connected to writing instrument 4200 by inserting the nub through the back opening 4283 and snugly into the recess of the cap holder 4203 of plug 4272.

FIG. 43 is a view of writing instrument 4200 as assembled. Shown in this diagram are body portion 4251 with a marking element 4250, and cover cartridge 4273, with back opening 4283, dispenser opening 4275, and flag 4295 protruding through dispenser opening 4275.

Although the foregoing disclosure has illustrated the integration of a tape flag dispenser into a highlighter, the teachings of the disclosure may be applied to other writing instruments and dispensers of sheet material other than tape flags without departing from the scope or spirit thereof. The tape flag dispensers disclosed herein can be employed with other writing instruments such as, but not limited to, pens, pencils, and markers. Further, it can be appreciated by one having ordinary skill in the art that the tape flag dispenser can be made without all of the features discussed in the illustrative embodiments, and that features from the various illustrative embodiments can be intercombined as appropriate for specific applications and situations.

What is claimed is:

1. A writing instrument with a sheet material dispenser comprising:

a writing instrument body portion;

a writing tip carried by the body portion;

a writing cap removably disposable over the writing tip, the writing cap including a first nub;

a dispenser base adapted for attachment to the writing instrument body portion;

a dispenser housing coupled to the dispenser base defining an interior receptacle, the dispenser housing further defining an opening in communication with the interior receptacle, the dispenser housing further including a recess sized and shaped to releasably receive the first nub of the writing cap; and a sheet material disposed in the housing interior receptacle, the sheet material having a thickness smaller than a width of the opening to allow a leading end of the sheet material to pass through the opening.

2. The writing instrument of claim 1, in which the interior receptacle has a generally cylindrical shape.

3. The writing instrument of claim 1, in which the dispenser base is formed integrally with the dispenser housing.

4. The writing instrument of claim 3, further comprising a barrel portion coupled to the dispenser base and disposed inside the dispenser housing.

5. The writing instrument of claim 4, in which a gap is defined between the barrel portion and the dispenser housing, and in which a top portion extends between the barrel portion and the dispenser housing to enclose the gap.

6. The writing instrument of claim 4, in which the roll of sheet material is formed in an annulus defining a central aperture sized for insertion over the barrel portion.

7. The writing instrument of claim 4, in which the barrel portion is hollow to define a cap recess sized to releasably engage the writing instrument body portion and to enclose the writing tip.

8. The writing instrument of claim 1, further comprising a second nub coupled to the base, in which an end of the writing instrument body portion opposite the writing tip defines a recess sized to releasably engage the second nub.

9. The writing instrument of claim 1, in which the dispenser base comprises an inner shell having an outer surface sized for insertion into the dispenser housing and an inner surface sized to receive the sheet material, and an end cover attached to one end of the inner shell, the inner shell being partially cylindrical and having opposing first and second shell ends defining an inner slot therebetween sized to receive at least the thickness of the sheet material.

10. The writing instrument of claim 9, in which the dispenser housing opening is formed as an outer slot in register with the inner slot.

11. The writing instrument of claim 9, in which the sheet material comprises a plurality of stacked sheets rolled into a semi-annular shape.

12. The writing instrument of claim 9, in which the sheet material comprises a plurality of stacked sheets having a transverse fold.

13. The writing instrument of claim 9, in which the roll of sheet material comprises a contiguous length of sheet material rolled into an annular shape.

14. The writing instrument of claim 9, in which the dispenser base is removably attached to the instrument body portion.

15. The writing instrument of claim 14, in which the dispenser base further includes a second nub, and in which an end of the writing instrument body portion opposite the writing tip defines a recess sized to releasably engage the second nub.

16. The writing instrument of claim 14, in which the dispenser housing defines a recess sized to releasably engage the writing instrument body portion and to enclose the writing tip.

17. The writing instrument of claim 9, in which the dispenser base is permanently attached to the writing instrument body portion.

18. The writing instrument of claim 9, in which the dispenser base is removably attached to the writing instrument body portion.

19. The writing instrument of claim 1, in which the dispenser base comprises a central blocking portion and an edge blocking portion extending partially around the central blocking portion to define an exposed section of the central blocking portion, the edge blocking portion having opposed contact edges, in which the dispenser housing comprises a partial cylindrical shell extending around the edge blocking portion and partially past the opposed contact edges, and in which the roll of sheet material comprises a plurality of stacked sheets rolled into a semi-annular shape having opposite ends engaging respective edge blocking portion contact edges and a rear stack surface engaging the central blocking portion exposed section.

20. The writing instrument of claim 1, in which the dispenser base comprises a cylindrical shell defining a slot in register with the dispenser housing opening and a chamber within the housing interior receptacle sized to receive the sheet material.

21. The writing instrument of claim 20, in which the sheet material comprises a plurality of stacked sheets having a transverse fold, and in which the cylindrical shell slot is sufficiently wide to allow insertion of the plurality of stacked sheets having a transverse fold therethrough.

22. The writing instrument of claim 20, in which the dispenser housing is movable to selectively place the housing opening out of register with the cylindrical shell slot.

23. The writing instrument of claim 22, in which the dispenser housing comprises a rotatable cap.

24. The writing instrument of claim 20, in which the writing instrument body portion defines a circular opening having an inner diameter and in which the dispenser base comprises an end cover having a first side attached to the cylindrical shell and a second side attached to a second nub, the second nub having an outer diameter corresponding to the circular opening inner diameter.

25. The writing instrument of claim 1, in which the dispenser base comprises a bottom wall and the dispenser housing comprises a back wall and a front wall coupled to the bottom wall and a top wall coupled to the back and front walls, wherein a slot formed in the front wall defines the dispenser housing opening.

26. The writing instrument of claim 25, in which a gap between the front and back walls is sized to allow insertion of the roll of sheet material into the housing interior receptacle.

27. The writing instrument of claim 25, in which the dispenser base further includes a central spindle extending through the housing interior receptacle and coupled to the bottom and top walls.

28. The writing instrument of claim 1, in which the roll of sheet material comprises a backing layer and a sheet material layer adhered to the backing layer, wherein the writing instrument further comprises a contact member disposed in the dispenser housing and defining a small radius contact surface over which the roll of sheet material is fed to at least partially separate the sheet material layer from the backing layer.

29. The writing instrument of claim 28, in which the dispenser housing opening comprises a first slot and the dispenser housing further defines a second slot, and in which the backing layer is fed through the first slot and the sheet material is fed through the second slot.

30. The writing instrument of claim 28, in which the contact member comprises a rod.

31. The writing instrument of claim 28, in which the contact member comprises a wedge.

32. The writing instrument of claim 1, in which the dispenser base includes an attachment end adapted to engage the writing instrument body portion, an end cover having a first side attached to the attachment end and a second side, and a spindle attached to the end cover second side and disposed inside the dispenser housing.

33. The writing instrument of claim 32, in which the dispenser base further includes a plug wall disposed axially along a length of the spindle.

34. The writing instrument of claim 33, in which the roll of sheet material comprises a plurality of stacked sheets rolled into a semi-annular shape having opposed ends, and in which the plurality of stacked sheets are disposed inside the dispenser housing so that the plug wall is located between the opposed ends.

35. The writing instrument of claim 32, in which a cap holder is coupled to the spindle, and the dispenser housing defines a back opening allowing access to the cap holder.

36. The writing instrument of claim 32, in which the dispenser housing is slidable relative to the dispenser base.

37. The writing instrument of claim 32, further comprising a sheet cartridge having a semi-annular side wall having a gap, the side wall defining an inner aperture sized for insertion over the spindle and an outer surface sized for insertion into the dispenser housing, the sheet cartridge holding the roll of sheet material.

38. The writing instrument of claim 37, in which the dispenser housing is slidable relative to the sheet cartridge.

39. The writing instrument of claim 38, in which the sheet cartridge further includes a stopper tab adapted to engage the dispenser housing, thereby to limit slidable movement of the dispenser housing relative to the sheet cartridge.

40. The writing instrument of claim 37, in which the dispenser housing and sheet cartridge are formed of transparent material.

41. The wilting instrument of claim 37, in which the sheet cartridge side wall gap is sized to allow the roll of sheet material to be inserted therethrough.

42. The writing instrument of claim 1, in which the writing instrument body portion defines a circular opening having an inner diameter and in which the dispenser base comprises a second nub having an outer diameter corresponding to the circular opening inner diameter.

43. The writing instrument of claim 42, in which the circular opening and insertion cylinder are formed with complementary grooves and ridges, respectively, to permanently affix the dispenser base to the writing instrument body portion.

44. The writing instrument of claim 1, in which the sheet material comprises a plurality of stacked sheets having a transverse fold.

45. A sheet material cartridge for use with a writing instrument, the cartridge comprising:

a dispenser base adapted for removable attachment to the writing instrument;

a dispenser housing coupled to the dispenser base defining an interior receptacle, the dispenser housing further defining an opening in communication with the interior receptacle; and sheet material comprising a plurality of sheets disposed in the dispenser housing interior receptacle, the sheet material having a thickness smaller than a width of the opening to allow the sheet material to pass through the opening;

wherein the dispenser base comprises a nub adapted to be releasably engaged in a recess in the writing instrument, and the dispenser housing comprises a rear surface including a recess sized to releasably engage a nub from a writing cap; and wherein the nub of the dispenser base has a shape that is complementary to the recess of the dispenser housing, such that the sheet material cartridge could be stacked with a similarly configured second sheet material cartridge.

46. The cartridge of claim 45, in which at least a portion of the housing extends adjacent to a length of the writing instrument.

47. The cartridge of claim 45, in which the plurality of sheets are arranged in a flat stack.

48. The cartridge of claim 45, in which the dispenser housing is releasably coupled to the dispenser base.

49. The cartridge of claim 45, in which the housing interior receptacle is generally cylindrical, and in which the plurality of sheets are arranged as a roll of sheet material.

50. The cartridge of claim 49, in which the dispenser base comprises an inner shell having an outer surface sized for insertion into the dispenser housing and an inner surface sized to receive the roll of sheet material, and an end cover attached to one end of the inner shell, the inner shell being partially cylindrical and having opposing first and second shell ends defining an inner slot therebetween sized to receive at least the thickness of the sheet material.

51. The cartridge of claim 50, in which the roll of sheet material comprises a contiguous length of sheet material rolled into an annular shape.

52. The cartridge of claim 50, in which the housing opening is formed as an outer slot in register with the inner slot.

53. The cartridge of claim 45, in which the plurality of sheets comprises a plurality of stacked sheets rolled into a semi-annular shape.

54. The cartridge of claim 45, in which the plurality of sheets comprises a plurality of stacked sheets having a transverse fold.

55. A writing instrument with a sheet material dispenser comprising:

a writing instrument body portion having a side wall and a rear wall, the rear wall including a recess, the side wall and the rear wall enclosing a rear end of an ink reservoir;

a writing tip carried by the body portion;

a dispenser base adapted for attachment to the writing instrument body portion, the dispenser base including a nub releasably disposable in the recess of the rear end;

a dispenser housing coupled to the dispenser base defining an interior receptacle, the dispenser housing further defining an opening in communication with the interior receptacle; and a roll of sheet material disposed in the housing interior receptacle, the sheet material having a thickness smaller than a width of the opening to allow a leading end of the roll of sheet material to pass through the opening.

* * * * *

UNITED STATES PATENT AND TRADEMARK OFFICE

CERTIFICATE OF CORRECTION

PATENT NO. : 7,322,766 B2
APPLICATION NO. : 10/803349
DATED : January 29, 2008
INVENTOR(S) : Jacqueline Erlebacher et al.

It is certified that error appears in the above-identified patent and that said Letters Patent is hereby corrected as shown below:

On the Cover Page:

At field (57), line 1, “flan” should be -- flag --.

Signed and Sealed this

First Day of July, 2008

JON W. DUDAS
*Director of the United States Patent and Trademark Office*